US008280291B2

(12) United States Patent
Yamamoto et al.

(10) Patent No.: US 8,280,291 B2
(45) Date of Patent: Oct. 2, 2012

(54) FIXING DEVICE AND IMAGE FORMING APPARATUS

(75) Inventors: Naoki Yamamoto, Toyohashi (JP); Satoru Yoneda, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/782,042

(22) Filed: May 18, 2010

(65) Prior Publication Data

US 2010/0296849 A1 Nov. 25, 2010

(30) Foreign Application Priority Data

May 25, 2009 (JP) ..... 2009-125120

(51) Int. Cl.
*G03G 15/20* (2006.01)

(52) U.S. Cl. ..... 399/329

(58) Field of Classification Search ..... 399/329, 399/328, 331; 219/216, 469–471
See application file for complete search history.

(56) References Cited

U.S. PATENT DOCUMENTS 6,993,279 B2 * 1/2006 Fukuzawa et al. ..... 399/329
7,060,349 B2 * 6/2006 Tamemasa et al. ..... 399/328
7,142,803 B2 * 11/2006 Koyama et al. ..... 399/329
7,493,074 B2 * 2/2009 Komuro ..... 399/328
2010/0215416 A1 * 8/2010 Yamamoto et al. ..... 399/331
2010/0284715 A1 * 11/2010 Yagi et al. ..... 399/329
2010/0290823 A1 * 11/2010 Okabe et al. ..... 399/331

FOREIGN PATENT DOCUMENTS

JP 2005-331576 A 12/2005
JP 2008-262097 A 10/2008
JP 2008-298935 A 12/2008
JP 2009-109697 A 5/2009

OTHER PUBLICATIONS

Decision to Grant a Patent mailed on May 10, 2011 for Japanese Application No. 2009-125120 and verified English Translation.

* cited by examiner

*Primary Examiner* — Susan Lee
(74) *Attorney, Agent, or Firm* — Buchanan Ingersoll & Rooney PC

(57) ABSTRACT

A fixing device for fixing an unfixed image on a recording sheet passing through a fixing nip formed by pressing a pressing member against an inside surface of a pressure belt via a low friction sheet, so that an outside surface of the pressure belt presses against a fixing member, wherein the pressing member includes a first pressing part whose front-side portion is an elastic pressing part, and a second pressing part whose front face presses against a rear face of the first pressing part, the second pressing part has a side wall near an upstream portion of the first pressing part that is upstream from the front-side portion with respect to a rotation direction of the pressure belt, and an upstream end of the low friction sheet, upstream from the other end with respect to the rotation direction, is sandwiched between the side wall and the upstream portion.

20 Claims, 13 Drawing Sheets

FIXING DEVICE AND IMAGE FORMING APPARATUS

This application is based on an application No. 2009-125120 filed in Japan, the contents of which are hereby incorporated by reference.

BACKGROUND OF THE INVENTION (1) Field of the Invention

The present invention relates to a fixing device for fixing an unfixed image formed on a recording sheet by applying heat and pressure to the unfixed image while the recording sheet is passing through the fixing nip, the fixing nip being formed by pressing a fixing roller and a pressure belt against each other. The present invention also relates to an image forming apparatus having the fixing device.

(2) Description of the Related Art

Image forming apparatuses such as photocopying machines are equipped with a fixing device for fixing an unfixed image formed on a recording sheet, such as a sheet of recording paper and an OHP sheet, by applying heat and pressure. Literature 1 (Japanese Patent Application Publication No. 2005-331576) discloses a belt nip type fixing device in which a fixing nip is formed between a roller and a belt. FIGS. 11-15 are schematic views illustrating the technology relating to the Literature 1. FIG. 11 is a schematic cross-sectional view illustrating the structure of the fixing device disclosed in the Literature 1.

In this fixing device, a fixing nip N is formed by pressing a fixing belt 62 against the surface of the heat roll 61, which is provided in parallel with the heat roll 61, toward the axis of the heat roll 61. The heat roll 61 rotates with the surface heated to a predetermined temperature. A pressure pad 63 for pressing the fixing belt 62 against the heat roll 61 is provided inside the area that the fixing belt 62 rotates around. The fixing belt 62 is pressed by the pressure pad 63 against the heat roll 61 which is driven to rotate, and accordingly the fixing belt 62 rotates as the heat roll 61 does. A heater 67 is provided along the axis of the heat roll 61.

The pressure pad 63 is attached to a supporting frame 65 via an elastic sheet 66. The supporting frame 65 is provided inside the area that the fixing belt 62 rotates around, and is biased toward the heat roll 61. By the biasing force (pressing force) applied to the supporting frame 65, the pressure pad 63 presses against the inside surface of the fixing belt 62, along the width direction of the fixing belt 62 (i.e. the axis direction of the heat roll 61).

A low friction sheet 64 for reducing the sliding friction between the pressure pad 63 and the fixing belt 62 is provided between them. Although FIG. 11 depicts the low friction sheet 64 and the fixing belt 62 as though they are away from each other and the pressure pad 63 does not press against the low friction sheet 64, this is for clearly showing the structures of the low friction sheet 64, the fixing belt 62 and the pressure pad 63. In reality, in a fixing device that has been built up, the low friction sheet 64 is pressed by the pressure pad 63 against the inside surface of the rotating fixing belt 62 such that the low friction sheet 64 slides on the inside surface of the rotating fixing belt 62.

The pressure pad 63 includes an elastic pressing part 63*a* and a rigid pressing part 63*b*. To the rigid pressing part 63*b*, the biasing force of the supporting frame 65 is applied via the elastic sheet 66. The elastic pressing part 63*a* is supported by the rigid pressing part 63*b* so as to press the inside surface of the fixing belt 62 via the low friction sheet 64. The elastic pressing part 63*a* consists of an elastic body. The rigid pressing part 63*b* is made from a rigid material that is harder than the elastic pressing part 63*a*.

FIG. 12 is a cross-sectional view showing the structure of the pressure pad 63, and FIG. 13 is a perspective view of the same. By the biasing force (pressing force), which is applied to the rigid pressing part 63*b* and transmitted to the elastic pressing part 63*a*, the elastic pressing part 63*a* is pressed against the inside surface of the fixing belt 62 via the low friction sheet 64. The rigid pressing part 63*b* has a rigid presser 63*c*, which is disposed downstream in the rotation direction of the fixing belt 62. The rigid presser 63*c*, provided along the elastic pressing part 63*a*, projects toward the heat roll 61. The edge of this projection of the rigid presser 63*c* presses against the inside surface of the fixing belt 62 via the low friction sheet 64.

The low friction sheet 64, which is pressed against the fixing belt 62 by the pressure pad 63, is configured to have a rectangular shape. The low friction sheet 64 is disposed along the width direction of the fixing belt 62 such that the downstream end of the low friction sheet 64, which is downstream from the other end in the rotation direction of the fixing belt 62, is positioned downstream from the rigid presser 63*c* of the rigid pressing part 63*b*. The width of the low friction sheet 64 is almost the same as the width of the fixing belt 62.

The low friction sheet 64 extending from its downstream end passes between the pressure pad 63 and the fixing belt 62, and bends away from the inside surface of the fixing belt 62 along the upstream lateral side of the pressure pad 63 with respect to the rotation direction of the fixing belt 62. The upstream end, 64*b*, of the low friction sheet 64 is inserted between the rigid pressing part 63*b* and the elastic sheet 66.

FIG. 14A is a front view of the upstream lateral side of the pressure pad 63. FIG. 14B is a developed view of the upstream end 64*b* of the low friction sheet 64. The face (i.e. rear face) of the rigid pressing part 63*b* that faces the elastic sheet 66 is provided with a plurality of locking parts 63*d* that project toward the elastic sheet 66. The locking parts 63*d* are arranged with predetermined gaps, along the width direction of the fixing belt 62. The upstream end 64*b* of the low friction sheet 64, which is inserted between the rigid pressing part 63*b* and the elastic sheet 66, is provided with a plurality of locking holes 64*a* that correspond to the locking parts 63*d* of the rigid pressing part 63. The locking parts 63*d* are to be inserted into the locking holes 64*a* in one-to-one correspondence.

As the locking parts 63*d* are inserted into the locking holes 64*a*, the upstream end 64*b* of the low friction sheet 64 is fixed to the rigid pressing part 63*b*. The low friction sheet 64, extending from the upstream end 64*b*, is pulled out along the lateral side of the rigid pressing part 63*b*, and is bent to pass between the pressure pad 63 and the fixing belt 62.

In the fixing device having such a structure, the pressure pad 63 presses against the inside surface of the fixing belt 62 via the low friction sheet 64, and therefore the low friction sheet 64 slides on the inside surface of the fixing belt 62 while being pulled downstream by the rotating fixing belt 62. The low friction sheet 64 is made of a material that does not produce a large friction either on the fixing belt 62 or on the pressure pad 63. Thus, the low friction sheet 64 reduces the sliding friction between the fixing belt 62 and the pressure pad 63.

SUMMARY OF THE INVENTION

However, with the above-explained structure for fixing the low friction sheet 64 by inserting the locking parts 63*d* of the rigid pressing part 63*b* into the locking holes 64*a* of the low friction sheet 64, there is a problem that it is impossible to realize long-term stability of the low friction sheet 64.

FIG. 15 is a schematic view showing the vicinity of the upstream end 64*b* of the low friction sheet 64 attached to the pressure pad 63, viewed from the bottom. This drawing illustrates the pulling force to be applied to the upstream end 64*b* while the fixing belt 62 rotates. Due to the rotation of the fixing belt 62, the upstream end 64*b* is pulled downstream in the rotation direction by a pulling force F. As a result, in the upstream end 64*b* of the low friction sheet 64 attached to the pressure pad 63, each of the locking parts 63*d* contacts the opposite end of the corresponding locking hole 64*a* to the pulling direction. Thus, stress is intensively applied to the opposite end. In particular, if the locking parts 63*d* have an angular shape, the stress concentrates on the angle.

In the upstream end 64*b* of the low friction sheet 64, if stress is intensively applied by the locking parts 63*d* arranged with the predetermined gaps along the width direction of the fixing belt 62, there is a risk that the stressed parts of the locking holes 64*a* will be damaged. Also, because of the intensive stress applied by the locking parts 63*d*, a wrinkle 64*d* might be made on the low friction sheet 64 between adjacent two of the locking holes 64*a*, where the stress is relieved.

If the wrinkle 64*d* is made on the low friction sheet 64, there is a risk that the low friction sheet 64 can not efficiently reduce the sliding friction between the fixing belt 62 and the pressure pad 63. Also, the wrinkle 64*d* might accelerate wearing away of the low friction sheet 64, or damage the low friction sheet 64. Moreover, the wrinkle 64*d* might cause uneven pressure to be applied to the fixing nip N, and thereby cause uneven gloss of the fixed image.

The present invention aims to solve the problems described above. For this purpose, the present invention provides a fixing device and an image forming apparatus that are capable of preventing a low friction sheet from being damaged, and preventing wrinkles from being made on the low friction sheet, and thereby realizing long-term stability of the low friction sheet.

To fulfill the aim, one aspect of the present invention is a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front-side portion, which presses the low friction sheet against the pressure belt, is an elastic pressing part that is made of an elastic material, and (ii) a second pressing part whose front face presses against a rear face of the first pressing part, the second pressing part has a side wall that is provided near an upstream portion of the first pressing part, the upstream portion being upstream from the front-side portion with respect to a rotation direction of the pressure belt, and an upstream end of the low friction sheet is sandwiched between the side wall of the second pressing part and the upstream portion of the first pressing part, the upstream end being upstream from the other end of the low friction sheet with respect to the rotation direction of the pressure belt.

Another aspect of the present invention is an image forming apparatus having a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes (i) a first pressing part whose front-side portion, which presses the low friction sheet against the pressure belt, is an elastic pressing part that is made of an elastic material, and (ii) a second pressing part whose front face presses against a rear face of the first pressing part, the second pressing part has a side wall that is provided near an upstream portion of the first pressing part, the upstream portion being upstream from the front-side portion with respect to a rotation direction of the pressure belt, and an upstream end of the low friction sheet is sandwiched between the side wall of the second pressing part and the upstream portion of the first pressing part, the upstream end being upstream from the other end of the low friction sheet with respect to the rotation direction of the pressure belt.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

Structure of Image Forming Apparatus

Figure 1:
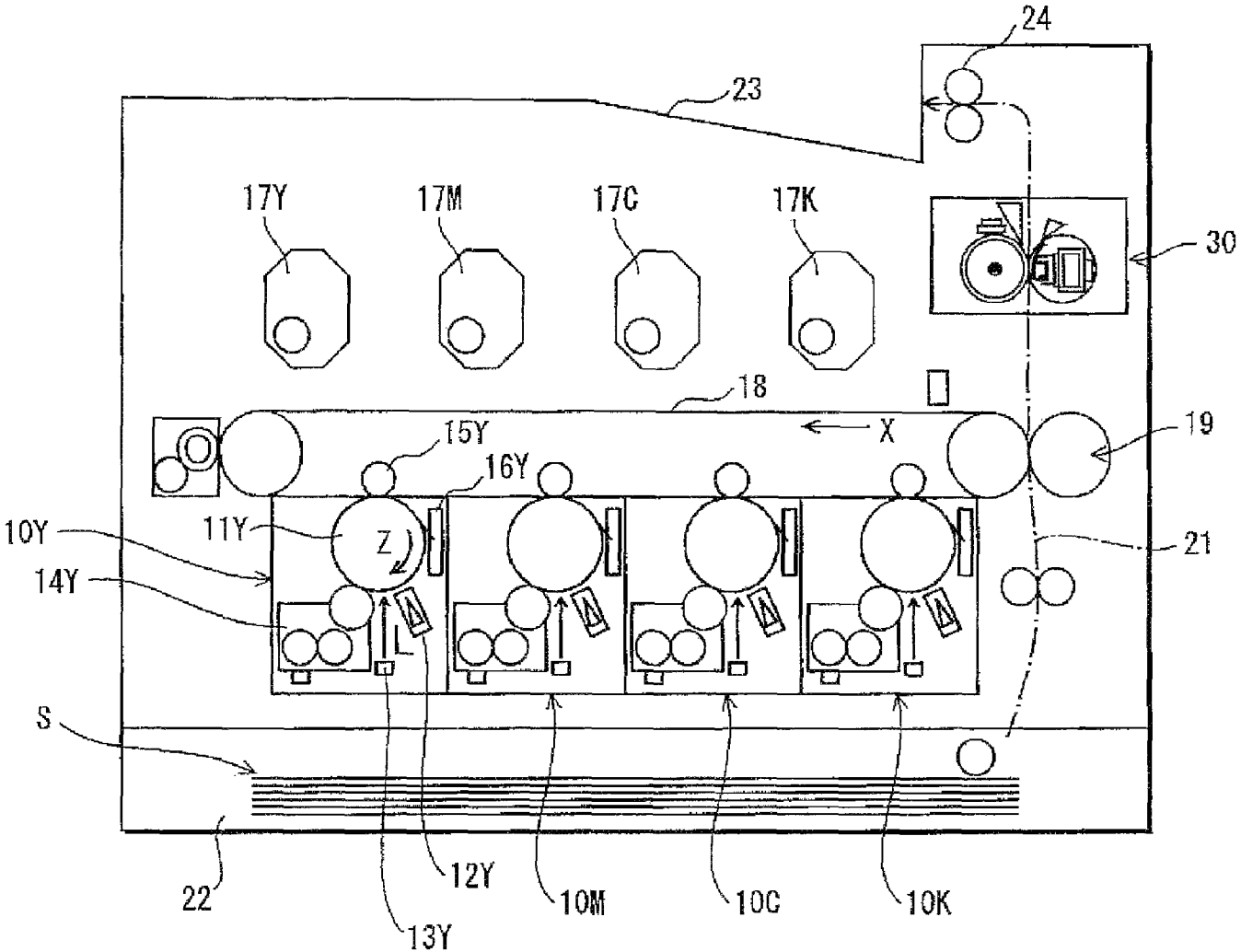
FIG. 1 is a schematic view showing the structure of a printer as an example of an image forming apparatus having an fixing device pertaining to an embodiment of the present invention.

FIG. 1 is a schematic view showing the structure of a color printer as an example of an image forming apparatus having a fixing device pertaining to an embodiment of the present invention. This printer forms a toner image by a known electrophotographic method, based on image data and so on received from an external terminal device or the like via a network (e.g., LAN). The toner image is transferred onto a recording sheet S, which is conveyed along a sheet conveyance path 21 from a paper feed cassette, which is provided in the bottom of the printer. The recording sheet S, on which the toner image has been transferred, is conveyed to a fixing device 30. The fixing device 30 fixes the toner image on the recording sheet S.

An intermediate transfer belt 18 is horizontally suspended, substantially at the center in the vertical direction of the printer. The intermediate transfer belt 18 is rotated in the direction of arrow X. Image forming units 10Y, 10M, 10C, and 10K are provided below the intermediate transfer belt 18. The image forming units 10Y, 10M, 10C and 10K are arranged along the rotating direction of the intermediate transfer belt 18, in the stated order from the upstream of the intermediate transfer belt 18.

Toner containers 17Y, 17M, 17C, and 17K are provided above the intermediate transfer belt 18 so as to respectively face the image forming units 10Y, 10M, 10C, and 10K via the intermediate transfer belt 18. The toner containers 17Y, 17M, 17C, and 17K provide yellow (Y) toner, magenta (M) toner, cyan (C) toner, and black (K) toner to the image forming units 10Y, 10M, 10C and 10K, respectively. The image forming units 10Y, 10M, 10C and 10K respectively form toner images by using the provided toner.

The image forming units 10Y, 10M, 10C, and 10K have substantially the same structure expect for the color of the toner for forming toner images. Thus, the following only describes the structure of the image forming units 10Y, and explanations of the others are omitted.

The image forming unit 10Y includes a photoreceptor drum 11Y, and a charger 12Y, an exposure part 13Y, and a developer 14Y. The photoreceptor drum 11Y is disposed below the intermediate transfer belt 18 so as to face intermediate transfer belt 18 and be rotable in the direction indicated as the arrow Z. The charger 12Y is disposed below the photoreceptor drum 11Y so as to face the photoreceptor drum 11Y. The exposure part 13Y and the developer 14Y are arranged in this order, downstream from the charger 12Y with respect to the rotation direction of the photoreceptor drum 11Y.

The surface of the photoreceptor drum 11Y is uniformly charged by the charger 12Y. An electrostatic latent image is formed on the surface of the photoreceptor drum 11Y by radiation with a laser beam L emitted from the exposure part 13Y. The electrostatic latent image formed on the surface of the photoreceptor drum 11Y is developed by the developer 14Y with Y-color toner provided from the toner container 17Y.

The developer 14Y includes a developer roller for carrying Y-color toner. The developer roller, being applied a development bias voltage, rotates and carries Y-color toner on the surfaces thereof. The Y-color toner attaches to the electrostatic latent image formed on the photoreceptor drum 11Y when it faces the photoreceptor drum 11Y. As a result, a Y-color toner image is formed on the surface of the photoreceptor drum 11Y.

Above the photoreceptor drum 11Y, a primary transfer roller 15Y is disposed so as to face the photoreceptor drum 11Y via the intermediate transfer belt 18. The toner image formed on the photoreceptor drum 11Y is primarily transferred to the intermediate transfer belt 18 by the effect of the transfer field generated by the transfer roller 15 to which the transfer bias voltage is being applied. The photoreceptor drum 11, onto which the toner image has been transferred, is cleaned up with a cleaner 16Y.

In the case of forming a full-color image, the timings of forming images on the image forming units 10Y, 10M, 10C, and 10K are shifted such that the toner images respectively formed on the photoreceptor drums 11Y, 11M, 11C and 11K are multiply transferred to the same area on the intermediate transfer belt 18. In the case of forming a monochrome image, only the selected image forming unit (e.g., the image forming unit 10K for K-color toner) is driven to form the toner image on the photoreceptor drum 11K, and the toner image is transferred onto a predetermined area on the intermediate transfer belt 18.

A secondary transfer roller 19 is disposed at the downstream end of the intermediate transfer belt 18 on which the toner image has been formed, with respect to the conveyance direction of thereof (i.e., the right side end in FIG. 1). The secondary transfer roller 19 faces the intermediate transfer belt 18 via the sheet conveyance path 21. The toner image transferred to the intermediate transfer belt 18 is secondarily transferred to the recording sheet S which is being conveyed along the sheet conveyance path 21, by the effect of the electrical field generated by the secondary transfer roller 19 to which the transfer bias voltage is being applied.

The recording sheet S which has passed between the intermediate transfer belt 18 and the secondary transfer roller 19 is conveyed to the fixing device 30 disposed above the secondary transfer roller 19. The fixing device 30 applies heat and pressure to the unfixed toner image on the recording sheet S, thereby fixing the toner image. The recording sheet S, on which the toner image has been fixed, is conveyed by the sheet ejection roller 24 to the sheet receiving tray 23 disposed above the toner containers 17Y, 17M, 17C and 17K.

Structure of Fixing Device

Figure 2:
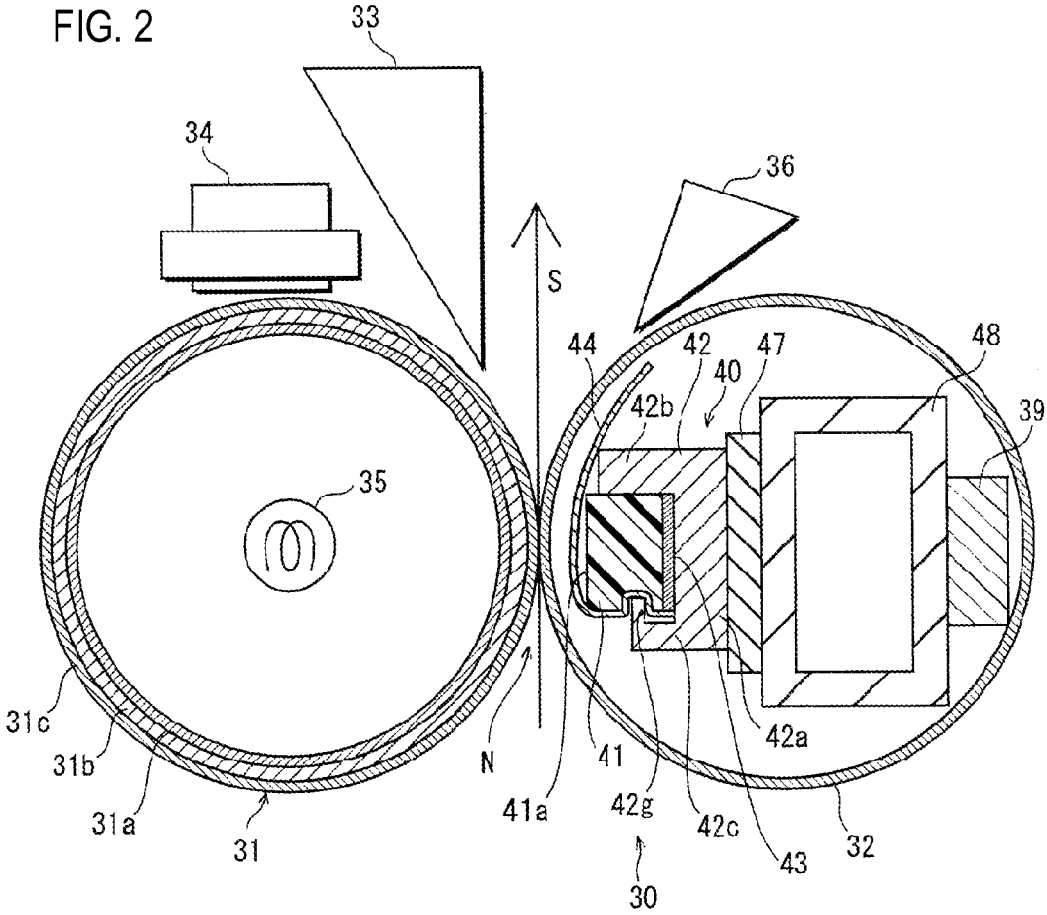
FIG. 2 is a schematic cross-sectional view illustrating the structure of the fixing device provided in the printer.

FIG. 2 is a schematic cross-sectional view showing the main components of the fixing device 30. The fixing device 30 includes a fixing roller 31 as a rotative fixing member, and a pressure belt 32 pressed against the fixing roller 31 by a pressing member 40. The pressure belt 32 is an endless belt, and is pressed by the pressing member 40 against the surface of the fixing roller 31 that is driven to rotate. Thus, the pressure belt 32 rotates according to the rotation of the fixing roller 31. A fixing nip N is formed by pressing the fixing roller 31 and the pressure belt 32 against each other.

The fixing roller 31 has a cylindrical shape. A heater 35 is provided along the axis of the fixing roller 31. The heater 35 is for heating the surface of the fixing roller 31 to a predetermined temperature at which toner is fused. The heater 35 is controlled based on the surface temperature of the fixing roller 31 detected by a thermistor 34.

An unfixed toner image on the recording sheet S conveyed to the fixing device 30 is to be fixed on the recording sheet S by application of heat and pressure while the recording sheet S passes through the fixing nip N. The fixing nip N is formed by pressing the pressure belt 32, which rotates, against the fixing roller 31, which rotates and has the surface heated to the predetermined temperature. The recording sheet S, on which the toner image has been fixed, is peeled off from the fixing roller 31 and the pressure belt 32 by separation claws 33 and 36, respectively.

For example, the fixing roller 31 has an outside diameter of 10-50 mm, and includes the following: a metal core 31*a* made from a metal pipe having a thickness of 0.1-5.0 mm, such as aluminum and steel; an intermediate layer 31*b* layered on the outside surface of the metal core 31*a*; and a surface layer 31*c* covering the surface of the intermediate layer 31*b*.

It is preferable that the thickness of the metal core 31*a* is 0.2-1.5 mm for example, in view of weight saving and reduction of the warm-up time (i.e. the time from the power-on to when the surface temperature of the fixing roller 31 has been increased to the temperature required for the fixing).

It is preferable that the intermediate layer 31*b*, formed between the metal core 31*a* and the surface layer 31*c* of the fixing roller 31, is made of a material that has elasticity and a high heat resistance, such as silicone rubber and fluororubber. Although the thickness of the intermediate layer may be determined arbitrarily, the thickness is preferably in the range of 0.05-2 mm. The intermediate layer 31*b* is resiliently deformed by the pressure belt 32 pressed against it by the pressing member 40.

To easily release the recording sheet S, the surface layer 31*c* covering the surface of the intermediate layer 31*b* is preferably formed from a fluorine-based tube or a fluorine-based coating, such as PFA, PTFE and ETEE. As a fluorine-based tube, products of Du Pont-Mitsui Fluorochemicals Co., Ltd., such as "PFA350-J", "451HP-J" and "951HP Plus" may be used. The surface layer 31*c* may have electrical conductivity. The thickness of the surface layer 31*c* is preferably in the range of 5-100 μm. The contact angle with water is preferably no less than 90°, and particularly preferable if it is no less than 110°. Surface roughness Ra of the surface layer 31*c* is preferably in the range of 0.01-50 μm.

The pressure belt 32 includes a substrate formed to be endless, from a band plate made of, for example, polyimide, polyphenylene sulfide, nickel, steel, SUS, or the like. To easily release the recording sheet S, the surface of the substrate may be covered with a surface layer formed from a fluorine-based tube or a fluorine-based coating, such as PFA, PTFE and ETEE. The surface layer may have electrical conductivity. The thickness of the surface layer is preferably in the range of 5-100 μm. Although the thickness of the pressure belt 32 is not necessarily limited to any value, it is preferable if the thickness is in the range of 0.05-2 mm. The outside diameter of the pressure belt 32 is preferably in the range of 20-100 mm. Both side-ends of the pressure belt 32 with respect to the width direction thereof are respectively guided by belt-guide members (not illustrated) such that the pressure belt 32 does not wobble.

The pressing member 40, which presses against the inside surface of the pressure belt 32, is a long member extending along the axis direction of the fixing roller 31. The pressing member 40 is provided inside the area that the pressure belt 32 rotates around, so as to face toward the fixing roller 31 via the pressure belt 32 and a low friction sheet 44. The pressing member 40 presses against the inside surface of the pressure belt 32 via the low friction sheet 44.

Figure 3:
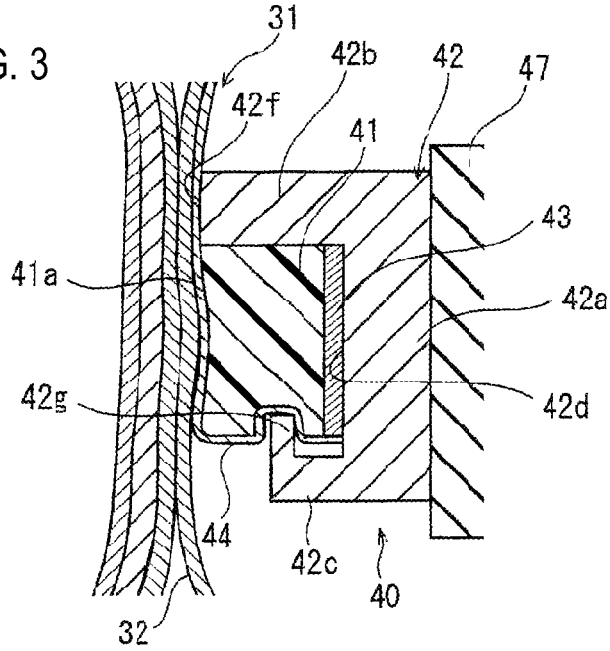
FIG. 3 is a cross-sectional view showing a practical state of the fixing device that has been built up.

In FIG. 2, the low friction sheet 44 is depicted as though it is away from the inside surface of the pressure belt 32 and the pressing member 40 does not presses the pressure belt 32. However, in the fixing device that has been built up as shown in FIG. 3, the pressing member 40 presses against the pressure belt 32 via the low friction sheet 44, and the pressure belt 32 is pressed against and contacts with the fixing roller 31. Accordingly, the fixing nip N is formed between the fixing roller 31 and the pressure belt 32.

The pressing member 40 includes a supporting frame 48, an elastic pressing part 41, a rigid pressing part 42, and a reinforcing part 43. The supporting frame 48 is provided inside the area that the pressure belt 32 rotates around. The rigid pressing part 42 is supported by the supporting frame 48 via an elastic sheet 47. The elastic pressing part 41 is supported by the rigid pressing part 42 so as to face the outside surface of the fixing roller 31 via a low friction sheet 44 and the pressure belt 32. The reinforcing part 43 is in the shape of a sheet and is attached to the elastic pressing part 41.

The supporting frame 48 is made from, for example, a drawn metal, an extruded metal, or a sheet metal. The metal is, for example, aluminum or steel. The supporting frame 48 is formed in a tubular shape having a rectangular cross section, for example. The supporting frame 48 extends along the width direction of the pressure belt 32 such that one face (the front face) thereof faces the fixing roller 31. Both ends of the supporting frame 48 with respect to the longitudinal direction protrude out of both ends of the pressure belt 32 with respect to the width direction, respectively. Each end of the supporting frame 48 is biased toward the fixing roller 31 by a biasing member such as a spring.

The elastic sheet 47 is provided on the front face of the supporting frame 48. An oil applying member 39 is provided on another face (i.e., the rear face) of the supporting frame 38, which is opposite to the front face on which the elastic sheet 37 is provided. The oil applying member 39 is for applying lubricating oil to the inside surface of the pressure belt 32. The oil applying member 39 is made from, for example, felt impregnated with lubricating oil. The oil applying member 39 slides on the inside surface of the pressure belt 32 that is rotating, so that lubricating oil is applied to the whole inside surface of the pressure belt 32.

Structure of Pressing Part

First Embodiment

Figure 4:
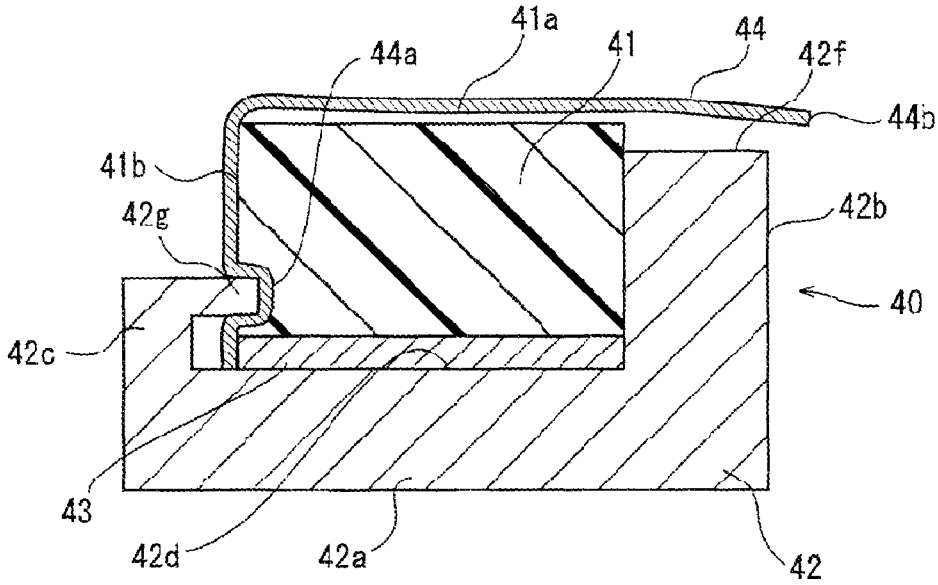
FIG. 4 is cross-sectional view of the main part of a pressing member provided in the fixing device.
Figure 5:
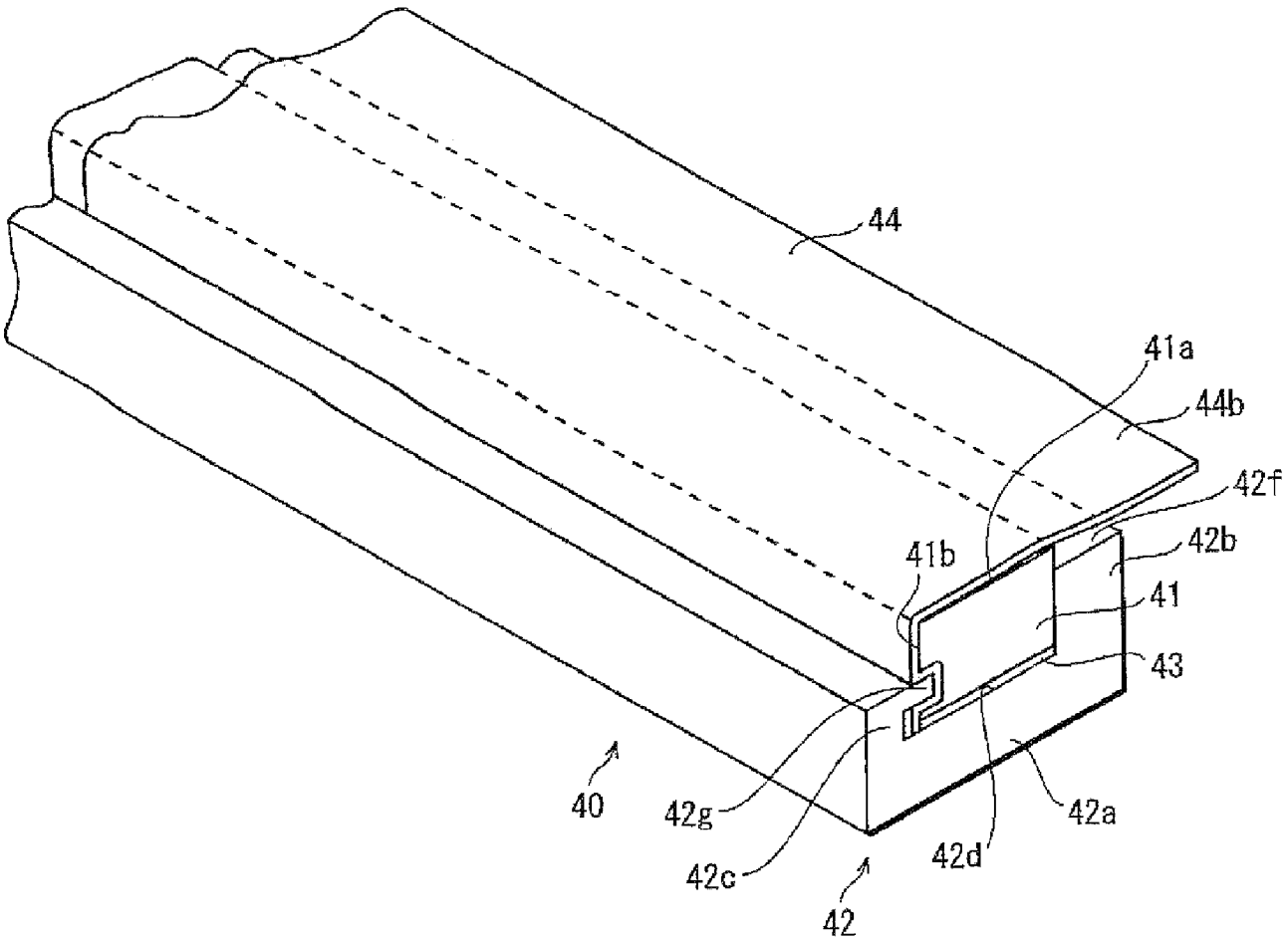
FIG. 5 is a perspective view of the main part of the pressing member.

FIG. 4 is cross-sectional view of the main part of the pressing member 40. FIG. 5 is a perspective view of the main part of the pressing member 40. Note that each of FIGS. 4 and 5 is depicted such that the upper side of the sheet of the drawing is the side where the fixing roller 31 exists. Also, each depicts the pressing member 40 in the state of not pressing against the pressure belt 32. Thus, the low friction sheet 44 is depicted as though being away from the pressure belt 32.

The rigid pressing part 42 disposed on the elastic sheet 47 includes a main supporting structure 42*a*, a rigid presser 42*b* and a side wall 42*c*. The main supporting structure 42*a* extends straight along the width direction of the pressure belt 32. The rigid presser 42*b* is provided along the downstream lateral side of the main supporting structure 42*a* with respect to the rotation direction of the fixing roller 31. The side wall 42*c* is provided along the upstream lateral side of the main supporting structure 42*a* with respect to the rotation direction of the fixing roller 31. The rigid pressing part 42 is integrally formed from a rigid material. The rigid presser 42*b* and the side wall 42*c* respectively protrude predetermined lengths toward the fixing roller 31. The protrusion of the side wall 42*c* is shorter than the protrusion of the rigid presser 42*b* of the main supporting structure 42*a*.

The length (width) of the main supporting structure 42*a* in the direction toward the fixing roller 31 is substantially even along the width direction of the pressure belt 32. Thus, the main supporting structure 42*a* is supported on the elastic sheet 47 such that the biasing force applied to the supporting frame 48 is transmitted evenly toward the fixing roller 31 across the full width of the pressure belt 32. The face of the main supporting structure 42*a* between the rigid presser 42*b* and the side wall 42*c* is a supporting face 42*d* for supporting the elastic pressing part 41. The supporting face 42*d* is flat across the conveying direction of the sheet S and the width direction of the pressure belt 32.

The elastic pressing part 41 supported by the supporting face 42*d* is made from an elastic material. When not pressing against the pressure belt 32, the elastic pressing part 41 is in the shape of a rectangular parallelepiped that extends along the width direction of the pressure belt 32, across the full width. The reinforcing part 43 in the form of a sheet is attached to the whole rear face of the elastic pressing part that faces toward the main supporting structure 42*a*. According to this embodiment, the elastic pressing part 41 and the reinforcing part 43 constitutes a first pressing part, and the rigid pressing member 42 constitutes a second pressing part.

In some cases, the elastic pressing part 41 can not keep the straight shape along the longitudinal direction thereof, depending on the thickness and the degree of the elasticity. That is, when supported by the rigid pressing part 42, the elastic pressing part 41 can not be kept straight along the width direction of the pressure belt 32. The reinforcing part 43 is provided for reinforcing the elastic pressing part 41 so that the elastic pressing part 41 is kept straight along the width direction of the pressure belt 32. The rigid pressing part 42 is made from a rigid material that is harder than the elastic pressing part 41.

The elastic pressing part 41 fits between the rigid presser 42*b* and the side wall 42*c* of the rigid pressing part 42, and is supported by the rigid pressing part 42 such that the reinforcing part 43 attached to the elastic pressing part 41 faces the supporting face 42*d* of the main supporting structure 42*a*. The lateral face (front face) of the elastic pressing part 41, which is on the side of the fixing roller 31, is an elastic pressing face 41*a*. The elastic pressing face 41*a* presses against the fixing roller 31 via the low friction sheet 44 and the pressure belt 32.

The edge of the side wall 42*c* covers an upstream lateral side 41*b* of the elastic pressing part 41, which is upstream from the elastic pressing face 41*a* with respect to the rotation direction of the pressure belt 32, along the whole width of the upstream lateral side 41*b* with respect to the width direction of the pressure belt 32. The edge has a protrusion 42*g* which protrudes toward the upstream lateral side 41*b* of the elastic pressing part 41. The protrusion 42*g* extends along the full width of the side wall 42*c*. The protrusion 42*g* protrudes a predetermined length from the side wall 42*c* toward the upstream lateral side 41*b* such that elastic pressing part 41 is resiliently depressed. The surface of the edge is flat and parallel with the upstream lateral side 41*b* of the elastic pressing part 41.

The elastic pressing face 41*a* of the elastic pressing part 41 is pressed against and contacts with the low fraction sheet 44 due to the pressure applied to the main supporting structure 42*a*. The elastic pressing part 41 presses against the inside surface of the pressure belt 32 via the low friction sheet 44, so that the pressure belt 32 is pressed against and contact with the fixing roller 31. The elastic pressing part 41 presses against the fixing roller 31 via the pressure belt 32 and the low friction sheet 44. Accordingly, the elastic pressing part 41 is resiliently deformed by the reaction force from the fixing roller 31. That is, it yields to the reaction force as shown in FIG. 3.

When the elastic pressing part 41 presses against the fixing roller 31 and yields to the reaction force and is resiliently deformed, a rigid pressing face 42*f*, which is the face of the protrusion of the rigid presser 42*b*, presses against the fixing roller 31 via the low friction sheet 44 and the pressure belt 32. Thus, the surface of the fixing roller 31 yields to the pressure and is resiliently deformed. The pressure belt 32 contacts with the fixing roller 31 along the surface of the fixing roller 31, and the fixing nip N is formed on the contact surfaces.

The main supporting structure 42*a*, the rigid presser 42*b* and the side wall 42*c* of the rigid pressing part 42 is integrally made from resin such as polyphenylene sulfide, polyimide, and liquid crystal polymer and metal such as aluminum and steel, and ceramic.

The elastic pressing part 41 is made from a material that has elasticity and a high heat resistance, such as silicone rubber and fluororubber. The Asker C hardness of the elastic pressing part 41 is preferably in the range of 15° to 30°. The thickness of the elastic pressing part 41 (i.e. the length along the protrusion of the rigid presser 42*b*) is in the range of 2.0 to 10 mm.

The reinforcing part 43 is made from a plate of metal such as aluminum and steel. The thickness of the reinforcing part 43 (i.e., the length along the protrusion of the rigid presser 42*b*) is in the range of 0.1 to 3 mm. The reinforcing part 43 is made by, for example, punching of a metal plate.

The low friction sheet 44 is provided between the pressing member 40 and the inside surface of the pressure belt 32, in order to reduce the sliding friction between the pressure belt 32 and the pressing member 40. The low friction sheet 44 is made from, for example, a glass cloth impregnated with heat-resistant resin. The glass cloth is a base material for the low friction sheet 44. As the heat-resistant resin, fluorine-based resin such as PTFE is usable.

The low friction sheet 44 is formed in a rectangular shape, and placed such that the orthogonal ends of the low friction sheet 44 extend along the width direction and the rotation direction of the pressure belt 32. The length of the low friction sheet 44 along the width direction of the pressure belt 32 is substantially equal to the length of the pressure belt 32 in the width direction. As FIG. 5 shows, a downstream end 44*b* of the low friction sheet 44, which is downstream from the other end in the rotation direction of the pressure belt 32, is positioned downstream from the rigid presser 42*b* of the rigid pressing part 42. The low friction sheet 44 extending from its downstream end passes between the inside surface of the pressure belt 32 and the rigid presser 42*b* of the rigid pressing part 42 and the elastic pressing part 41.

The part of the low friction sheet 44 that is extended upstream from the part between the inside surface of the pressure belt 32 and the elastic pressing part 41 is bent away from the pressure belt 32, and is extended along the upstream lateral side 41*b*. An upstream end 44*a* of the low friction sheet 44, which is upstream with respect to the rotation direction of the pressure belt 32, passes through between the protrusion 42*g* of the side wall 42*c* of the rigid pressing part 42 and the upstream lateral side 41*b* of the elastic pressing part 41. The full width of the upstream end 44*a* with respect to the width direction of the pressure belt 32 is held between the protrusion 42*g* and the upstream lateral side 41*b* of the elastic pressing part 41, along the full width of the upstream end 44*a* with respect to the width direction of the pressure belt 32.

The upstream lateral side 41*b* of the elastic pressing part 41 is resiliently depressed by the edge of the protrusion 42*g*. The upstream end 44*a* of the low friction sheet 44 is pressed against the elastic pressing part 41 by the protrusion 42*g*, and held between the protrusion 42*g* and the upstream lateral side 41*b* of the elastic pressing part 41, along the surface of the depression of the upstream lateral side 41*b* of the elastic pressing part 41.

The low friction sheet 44, extending from the upstream end 44*a* sandwiched between the protrusion 42*g* and the upstream lateral side 41*b* of the elastic pressing part 41, is pulled out along the upstream lateral side 41*b* of the elastic pressing part 41 toward the fixing roller 31, and passes between the inside surface of the pressure belt 32 and the elastic pressing part 41 and between the inside surface of the pressure belt 32 and the rigid presser 42*b* of the rigid pressing part 42. Thus, the low friction sheet 44 slides on the pressure belt 32 while being pressed against the inside surface of the rotating pressure belt 32 by the elastic pressing part 41 and the rigid presser 42*b* of the rigid pressing part 42.

As FIG. 2 and FIG. 3 show, in the fixing device 30 with the stated structure, the pressure belt 32, which is pressed against and contacts with the fixing roller 31, rotates in accordance with the rotation of the fixing roller 31 which is driven to rotate. Under such a condition, the recording sheet S, on which a toner image has been transferred at the transfer nip where the intermediate transfer belt 18 and the secondary transfer roller 19 are pressed against each other, goes into the fixing nip N between the fixing roller 31 and the pressure belt 32. Here, regarding the sheet S, the side on which the toner image has been transferred faces the fixing roller 31. The toner image on the recording sheet S is fixed on the recording sheet S while it passes through the fixing nip N.

After passing through the part where the pressure belt 32 and the fixing roller 31 are pressed against each other by the elastic pressing part 41, the recording sheet S then passes through the part where the pressure belt 32 is pressed against the fixing roller 31 harder by the rigid presser 42*b* of the rigid pressing part 42, and is discharged from the fixing nip N. Near the exit of the fixing nip N, the fixing roller 31 is pressed hard by the rigid presser 42*b* of the rigid pressing part 42. Thus, the fixing roller 31 is resiliently deformed in the shape with a small radius of curvature. The recording sheet S is separated from the fixing roller 31 because it can not follow the rotation of the fixing roller 31 due to the resiliently deformed part with the small radius of curvature. This is called "self stripping".

Lubricating oil is applied to the inside surface of the rotative pressure belt 32 by the oil applying member 39. The lubricating oil penetrates into the interface between the inside surface of the pressure belt 32 and the low friction sheet 44. The surface of the low friction sheet 44 has unevenness of the glass cloth as the basic material. Thus, even when the low friction sheet 44 is pressed against the inside surface of the pressure belt 32, the lubricating oil applied to the inside surface of the pressure belt 32 is not pushed out from the interface between the inside surface of the pressure belt 32 and the low friction sheet 44, and remains in the concavities on the low friction sheet 44. The lubricating oil reduces the sliding friction between the inside surface of the pressure belt 32 and the low friction sheet 44. Thus, the pressure belt 32 rotates smoothly.

As FIG. 3 shows, the pressing member 40 presses against the inside surface of the rotating pressure belt 32, via the low friction sheet 44, so that the pressure belt 32 and the fixing roller 31 are pressed against and contact with each other. As a result, a pulling force toward the rotation direction of the pressure belt 32 is applied to the low friction sheet 44 inserted between the pressure belt 32 and the elastic pressing part 41, while the pressure belt 32 is rotating.

In this case, since the full width of the upstream end 44*a* of the low friction sheet 44 with respect to the width direction of the pressure belt 32 is held between the protrusion 42*g* of the rigid pressing part 42 and the upstream lateral side 41*b* of the elastic pressing part 41, the pulling force applied to the upstream end 44*a* is substantially evenly distributed across the whole area of the upstream end 44*a*. Thus, the stress due to the pulling force is not intensively applied to any particular area on the upstream end 44*a*. This prevents the low friction sheet 44 from being damaged, and prevents wrinkles from being made on the low friction sheet 44.

The protrusion 42*g* of the rigid pressing part 42 presses so hard against the upstream end 44*a* of the low friction sheet 44 that the elastic pressing part 41 is resiliently depressed. Thus, the pressure from the protrusion 42*g* and the elastic pressing part 41 for holding the upstream end 44*a* of the low friction sheet 44 is high. This prevents the upstream end 44*a* from slipping out from between the protrusion 42*g* and the elastic pressing part 41.

Also, the low friction sheet 44 is held between the protrusion 42*g* of the side wall 42*c* and the elastic pressing part 41 so as to extend along the lateral side of the elastic pressing part 41. Thus, the length of the low friction sheet 44 along the rotation direction of the pressure belt 32 is shorter and the area of the low friction sheet 44 is smaller than the cases shown in FIGS. 11 to 15, in which the upstream end 44*a* of the low friction sheet 44 is fixed between the rigid pressing part 42 and the elastic sheet 47. This reduces the usage amount of the low friction sheet 44, and improves the economic efficiency.

The width of the upstream end 44*a* of the low friction sheet 44, which is sandwiched between the elastic pressing part 41 and the protrusion 42*g* of the rigid pressing part 42, is not limited to the width of the pressure belt 32. The width may be determined to be within the range that does not cause wrinkles. However, it is preferable that the width of the upstream end 44*a* is at least greater than the width of the recording sheet S passing through the fixing nip N formed by the pressure-contact between the fixing roller 31 and the pressure belt 32. Here, the width of the recording sheet means the length in the width direction of the pressure belt 32.

The width of the low friction sheet 44 is not necessarily equal to the whole width of the pressure belt 32. That is, the low friction sheet 44 may be shorter than the width of the pressure belt 32.

Modification Example 1 of Pressing Member

Figure 6:
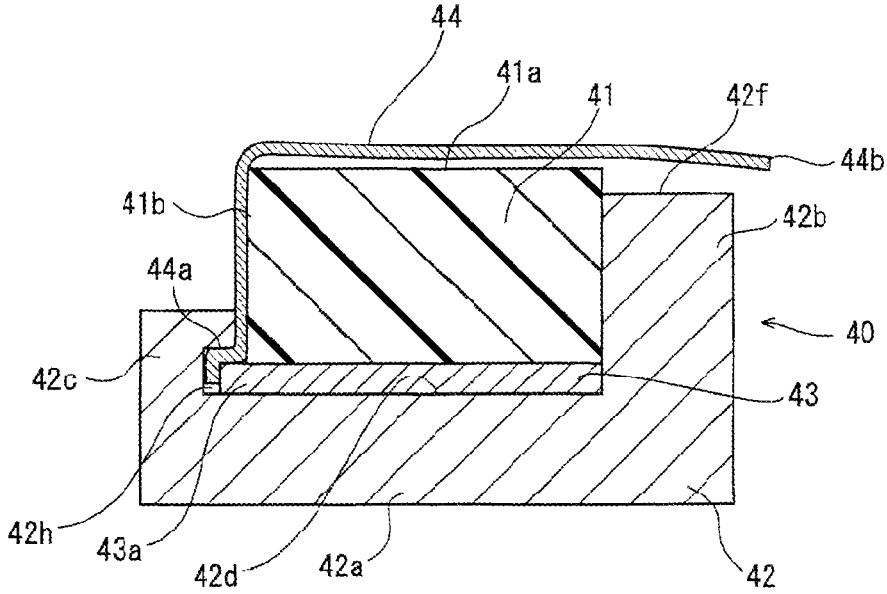
FIG. 6 is a cross-sectional view of the main part of another example of the pressing member used in the fixing device pertaining to the embodiment of the present invention.

FIG. 6 is a cross-sectional view of the main part of another example of the pressing member 40 used in the fixing device pertaining to the embodiment of the present invention. In the pressing member 40 shown in FIG. 6, the full width of one end of the reinforcing part 43 with respect to the width direction of the pressure belt 31, which is closer to the side wall 42*c* of the rigid pressing part 42 than the other end, protrudes toward the side wall 42*c*, farther than the upstream lateral side 41*b* of the elastic pressing part 41. This protruding end is hereinafter referred to as a sheet holder 43*a*.

The side wall 42*c* of the rigid pressing part 42 covers the sheet holder 43*a* of the reinforcing part 43. The side wall 42*c* has a groove 42*h* that extends across the full width of the side wall 42*c*. The sheet holder 43*a* fits to the groove 42*h*. The cross section of the groove 42*h* is in the shape of a rectangular.

The inside surface of the groove 42*h* is contiguous with the supporting face 42*d* of the main supporting structure 42*a*.

The low friction sheet 44 passes through between the upstream lateral side 41*b* of the elastic pressing part 41 and the edge of the side wall 42*c*, and is bent along the contour of the sheet holder 43*a* such that the upstream end 44*a* of the low friction sheet 44 is inserted into the groove 42*h* of the side wall 42*c* together with the sheet holder 43*a*.

The upstream end 44*a* is bent at a right angle along the upper and lateral inside surfaces of the groove 42*h*, such that the upstream end 44*a* is sandwiched between the sheet holder 43*a* inserted into the groove 42*h* and the upper and lateral inside surfaces of the groove 42*h*. The other components are the same as the pressing member 40 shown in FIG. 4 and FIG. 5.

It is the same in the pressing member 40 shown in FIG. 6 that the full width of the upstream end 44*a* of the low friction sheet 44 with respect to the width direction of the pressure belt 32 is held between the lateral inside surface of the groove 42*h* in the side wall 42*c* and the sheet holder 43*a* of the reinforcing part 43. Thus, the pulling force applied to the upstream end 44*a* is evenly distributed across the whole area of the upstream end 44*a*. Therefore, the stress due to the pulling force is not intensively applied to any particular area on the upstream end 44*a*. This prevents the low friction sheet 44 from being damaged, and prevents wrinkles from being made on the low friction sheet 44.

The side wall 42*c* and the sheet holder 43*a* of the reinforcing part 43 are respectively made from rigid materials harder than the elastic pressing part 41. Thus, the upstream end 44*a* of the low friction sheet 44 is held by a high pressure from the side wall 42*c* and the sheet holder 43*a*. This prevents the upstream end 44*a* from slipping out from the groove 42*h* in the side wall 42*c*.

Modification Example 2 of Pressing Member

Figure 7:
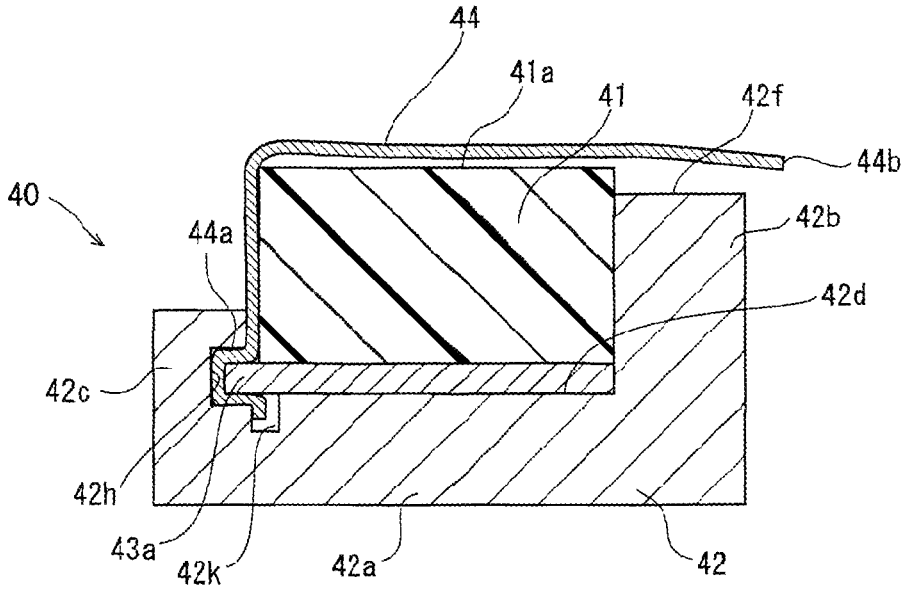
FIG. 7 is a cross-sectional view of the main part of yet another example of the pressing member used in the fixing device pertaining to the embodiment of the present invention.

In the pressing member 40 shown in FIG. 6, the upstream end 44*a* of the low friction sheet 44 may be, as shown in FIG. 7, extended toward the main supporting structure 42*a*, running over the groove 42*h* in the side wall 42*c*. If this is the case, a depression 42*k* may be provided in the supporting face 42*d* of the main supporting structure 42*a* across the full-width of the supporting face 42*d* with respect to the width direction of the pressure belt 32, such that the running-over part of the upstream end 44*a* fits into the groove 42*h*.

With such a structure, the upstream end 44*a* of the low friction sheet 44 follows the whole inside surface of the groove 42*h* provided in the side wall 42*c*, and is held by the whole inside surface of the groove 42*h* and the sheet holder 43*a* inserted into the groove 42*h*. Thus, a long portion of the upstream end 44*a* is held along the rotation direction of the pressure belt 32. This more surely prevents the upstream end 44*a* from slipping out from the groove 42*h* in the side wall 42*c*.

Modification Example 3 of Pressing Member

Figure 8A:
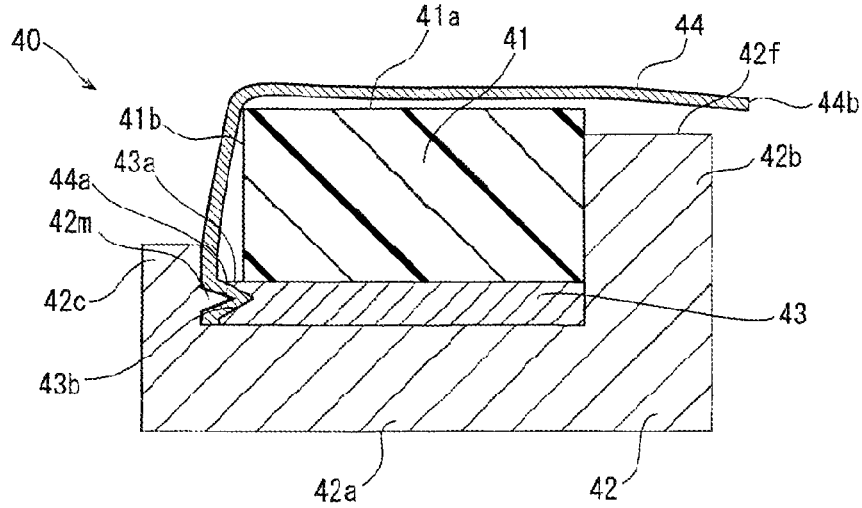
FIG. 8A is a cross-sectional view of the main part of yet another example of the pressing member used in the fixing device pertaining to the embodiment of the present invention.
Figure 8B:
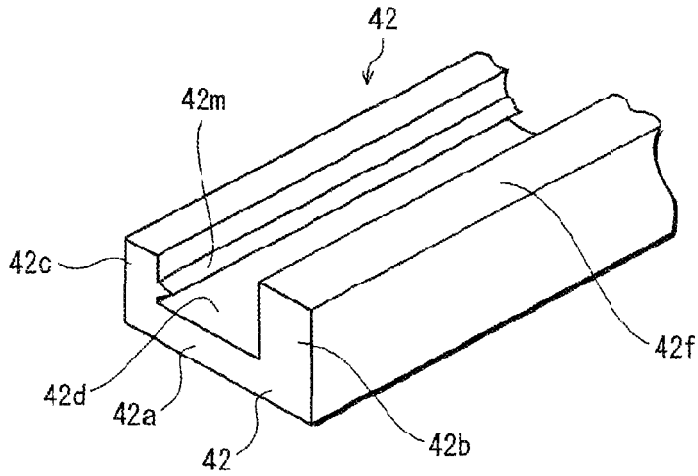
FIG. 8B is a perspective view of part of a rigid presser of the example of the pressing member shown in FIG. 8A.
Figure 8C:
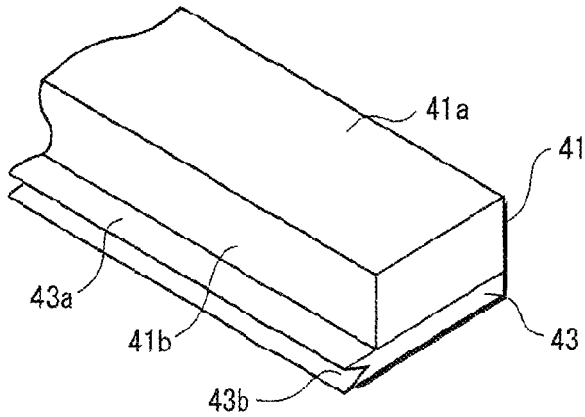
FIG. 8C is a perspective view of part of an elastic pressing part and part of a reinforcing part of the example of the pressing member shown in FIG. 8A.

FIGS. 8A-8C each show the main part of yet another example of the pressing member 40 used in the fixing device 30 pertaining to the embodiment of the present invention. FIG. 8A is a cross-sectional view of the main part of the pressing member 40. FIG. 8B is a perspective view of part of the rigid presser 42 of the pressing member 40. FIG. 8C is a perspective view of part of the elastic pressing part 41 and a part of the reinforcing part 43.

In the pressing member 40 shown in FIG. 8A, in the same manner as in the reinforcing part 43 shown in FIG. 6, one end of the reinforcing part 43, closer to the side wall 42*c* of the rigid pressing part 42 than the other end, protrudes toward the side wall 42*c*, farther than the upstream lateral side 41*b* of the elastic pressing part 41. This protruding end is the sheet holder 43*a*. Note that the thickness of the reinforcing part 43 of the pressing member 40 shown in FIG. 8A is greater than the thickness of the reinforcing part 43 shown in FIG. 6.

As shown in FIG. 8B, an engaging protrusion 42*m*, which protrudes toward the reinforcing part 43, is provided on the inside surface of the side wall 42*c* of the rigid pressing part 42. The engaging protrusion 42*m* is provided across the full width of the side wall 42*c*, with respect to the width direction of the pressure belt 31. The engaging protrusion 42*m* has a sharp edge and thus the cross section of the engaging protrusion 42*m* is in the shape of a triangle.

Further, as shown in FIG. 8C, an engaging groove 43*b* for engagement with the engaging protrusion 42*m* on the side wall 42*c* is provided in the sheet holder 43*a* of the reinforcing part 43. The engaging groove 43*b* is provided across the full width of the sheet holder 43*a* of the reinforcing part 43 with respect to the width direction of the pressure belt 31. The cross section of the engaging groove 43*b* is in the shape of a triangle that matches the engaging protrusion 42*m*.

The upstream end 44*a* of the low friction sheet 44 is bent along the inside surface of the engaging groove 43*b* provided in the sheet holder 43*a* of the reinforcing part 43 such that the upstream end 44*a* is sandwiched between the engaging protrusion 42*m*, which is fit into the engaging groove 43*b*, and the inside surface of the engaging groove 43*b*. The other components are the same as the pressing member 40 shown in FIG. 6.

In the pressing member 40 shown in FIGS. 8A, 8B and 8C, the upstream end 44*a* of the low friction sheet 44 is sandwiched between the engaging groove 43*b* provided in the sheet holder 43*a* of the reinforcing part 43 and the engaging protrusion 42*m*, across the full width of the upstream end 44*a* with respect to the width direction of the pressure belt 32. Thus, the pulling force applied to the upstream end 44*a* is evenly distributed across the whole area of the upstream end 44*a*. Therefore, the stress due to the pulling force is not intensively applied to any particular area on the upstream end 44*a*. This prevents the low friction sheet 44 from being damaged, and prevents wrinkles from being made on the low friction sheet 44. Also, the upstream end 44*a* of the low friction sheet 44 is held by a high pressure from the sheet holder 43*a* having a triangular cross section and the engaging protrusion 42*m* also having a triangular cross section. This prevents the upstream end 44*a* from slipping out from the engaging groove 43*b*.

Modification Example 4 of Pressing Member

Figure 9A:
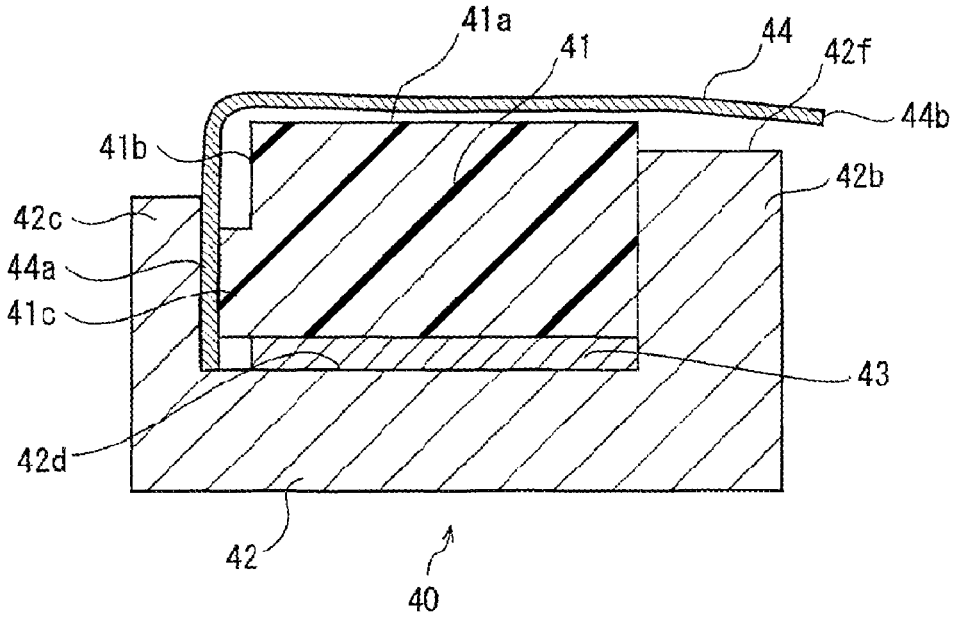
FIG. 9A is a cross-sectional view of the main part of yet another example of the pressing member used in the fixing device pertaining to the embodiment of the present invention.
Figure 9B:
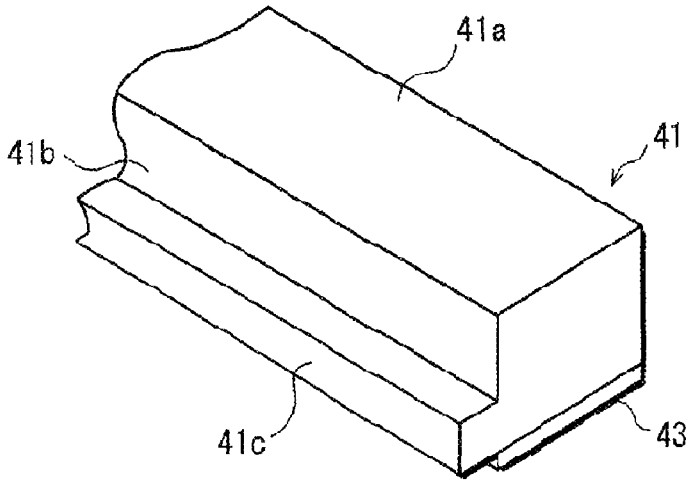
FIG. 9B is a perspective view of part of an elastic pressing part and part of a reinforcing part of the example of the pressing member shown in FIG. 9A.

FIGS. 9A and 9B each show the main part of yet another example of the pressing member 40 used in the fixing device 30 pertaining to the embodiment of the present invention. FIG. 9A is a cross-sectional view of the main part of the pressing member 40. FIG. 9B is a perspective view of part of the elastic pressing part 41 and part of the reinforcing part 43 used in the pressing member 40. In the pressing member 40 shown in FIG. 9A, the side wall 42*c* of the rigid pressing part 42 protrudes toward the fixing roller 31, in parallel with the upstream lateral side 41*b* of the elastic pressing part 41. There is a predetermined gap between the side wall 42*c* and the upstream lateral side 41*b*.

As shown in FIG. 9A and FIG. 9B, an elastic presser 41*c*, which protrudes toward the side wall 42*c* of the rigid pressing part 42, is provided on the upstream lateral side 41*b* of the elastic pressing part 41, which is upstream from the elastic pressing face 41*a* thereof with respect to the rotation direction of the pressure belt 31. The elastic presser 41*c* is provided across the full width of the upstream lateral side 41*b* with respect to the width direction of the pressure belt 31.

The upstream end 44*a* of the low friction sheet 44 passes between the elastic presser 41*c*, provided on the upstream lateral side 41*b* of the elastic pressing part 41, and the side wall 42*c* of the rigid pressing part 42, such that the upstream end 44*a* is pressed by the elastic presser 41*c* against the side wall 42*c* and is held therebetween. The other components are the same as the pressing member 40 shown in FIG. 4 and FIG. 5.

It is the same in the pressing member 40 shown in FIGS. 9A and 9B that the pulling force applied to the upstream end 44*a* is evenly distributed across the whole area of the upstream end 44*a*. Therefore, the stress due to the pulling force is not intensively applied to any particular area on the upstream end 44*a*. This prevents the low friction sheet 44 from being damaged, and prevents wrinkles from being made on the low friction sheet 44.

Another Structure of Pressing Member

Second Embodiment

Figure 10:
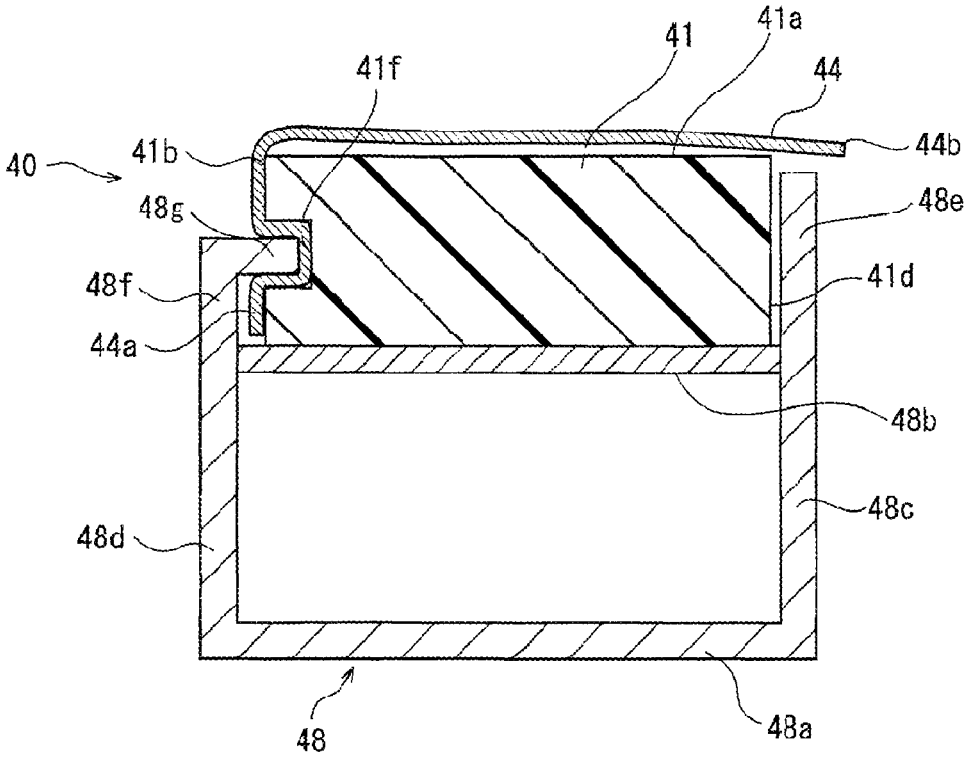
FIG. 10 is a cross-sectional view of yet another example of the pressing member used in the fixing device pertaining to the embodiment of the present invention.
Figure 11:
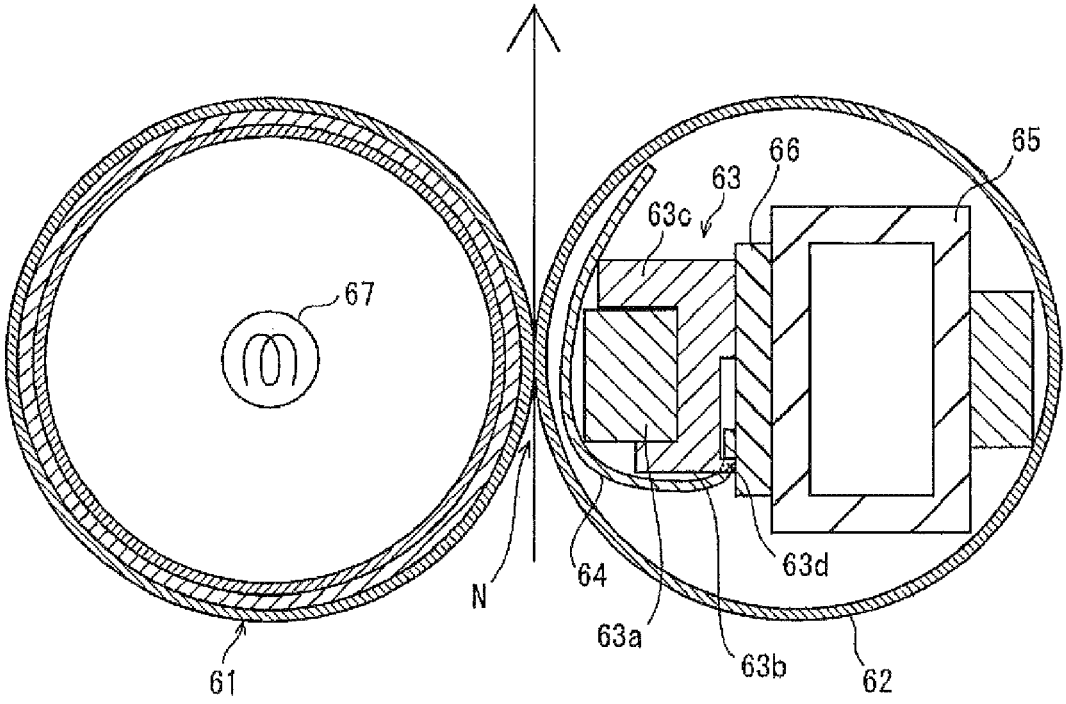
FIG. 11 Prior Art
FIG. 11 is a schematic cross-sectional view illustrating the structure of a conventional fixing device.
Figure 12:
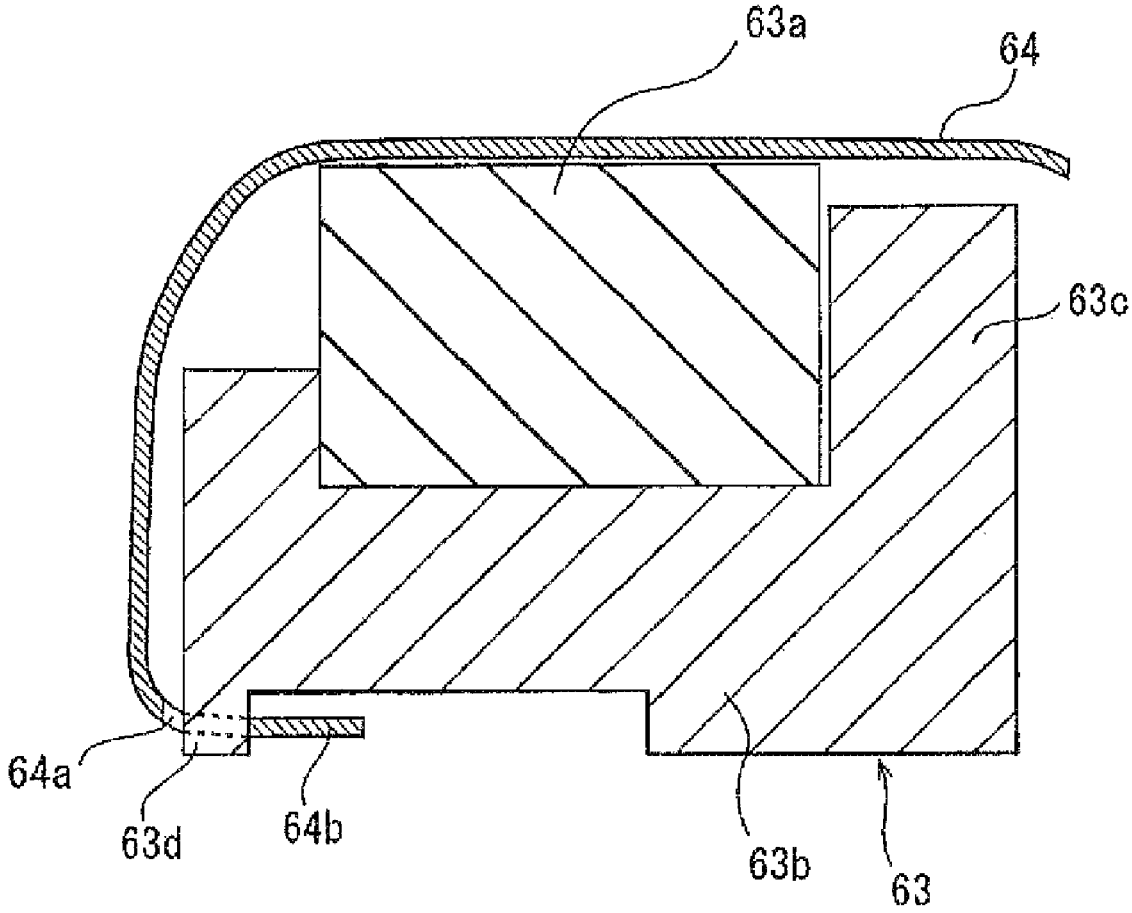
FIG. 12 Prior Art
FIG. 12 is a cross-sectional view of a pressure pad used in the conventional fixing device.
Figure 13:
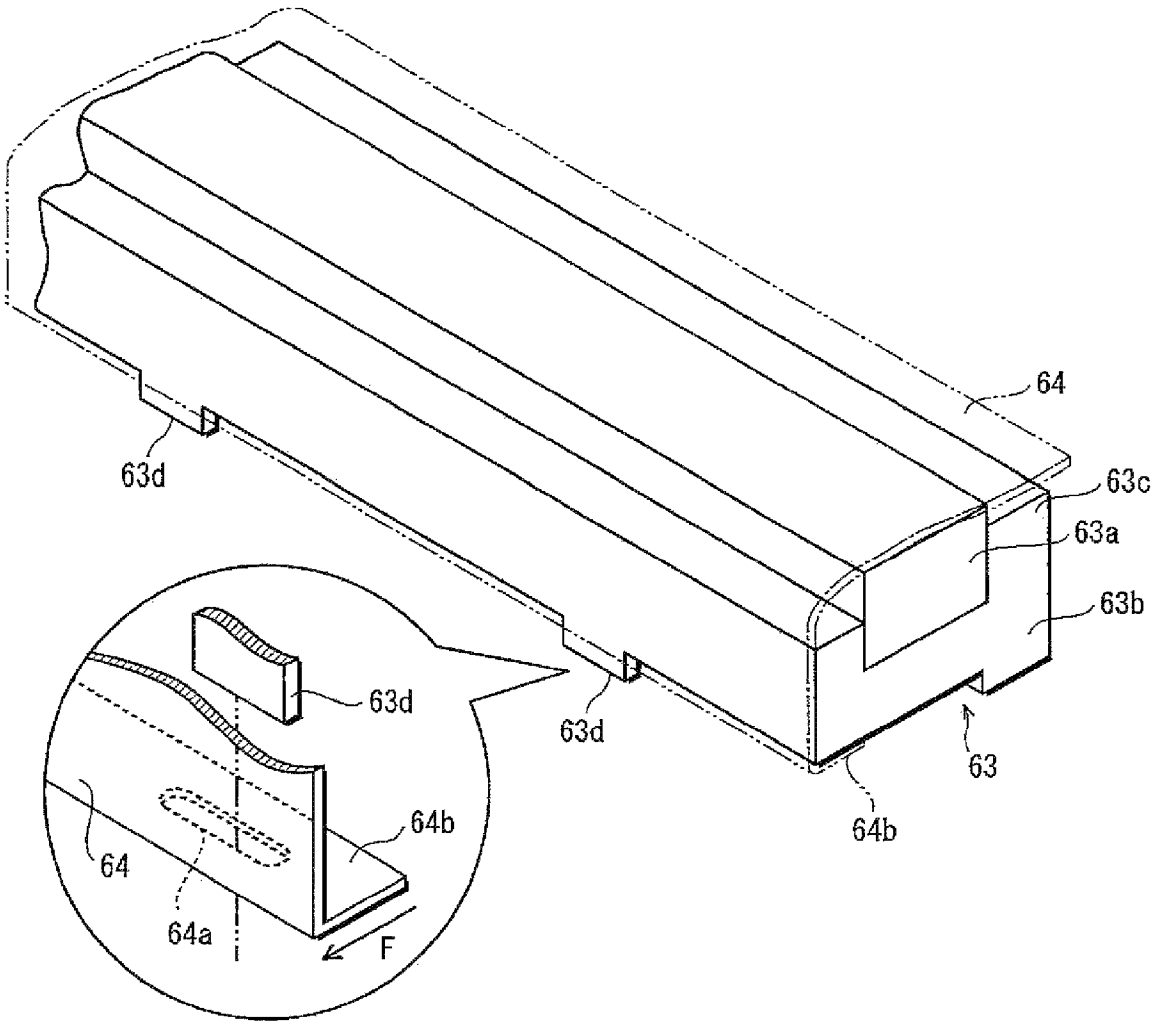
FIG. 13 Prior Art
FIG. 13 is a perspective view showing a part of the pressure pad.
Figure 14A:
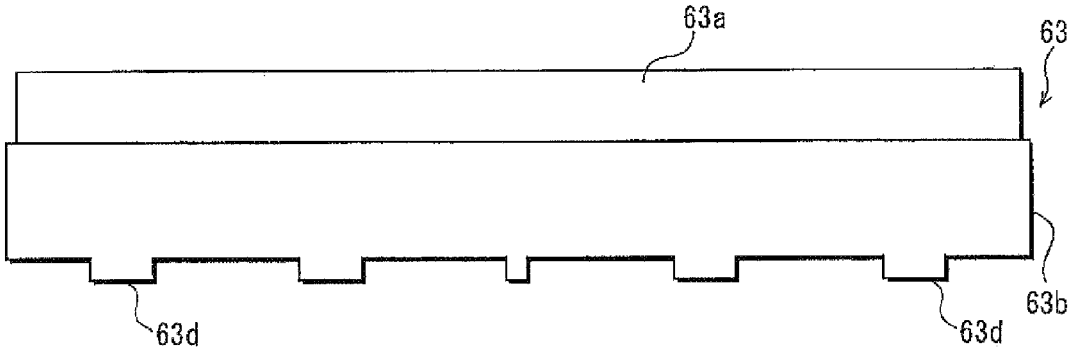
FIG. 14A Prior Art
FIG. 14A is a front view of the pressure pad.
Figure 14B:
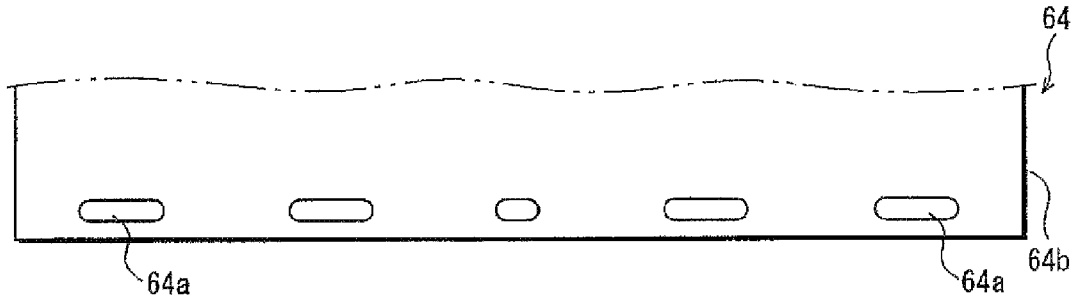
FIG. 14B Prior Art
FIG. 14B is a developed view of the upstream end of a low friction sheet with respect to the rotation direction of a fixing belt.
Figure 15:
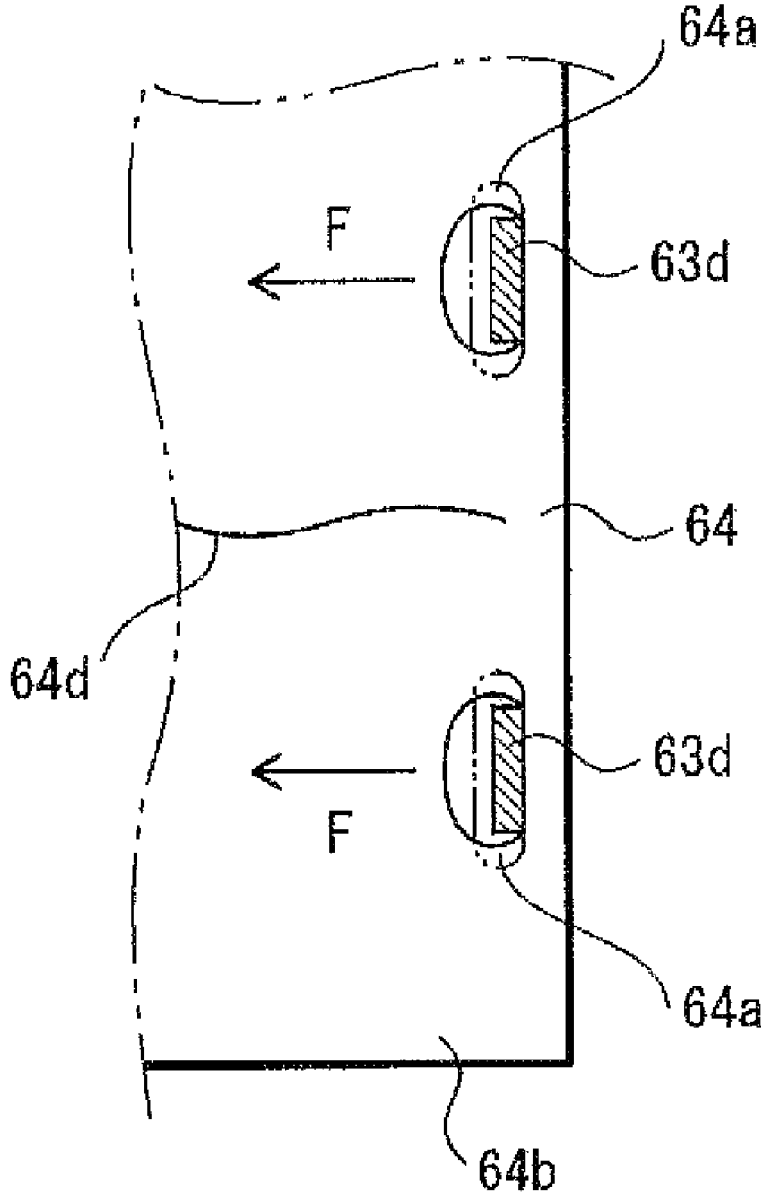
FIG. 15 Prior Art
FIG. 15 is a schematic view showing the upstream end of the low friction sheet attached to the pressure pad viewed from the bottom, which illustrates the pulling force to be applied to the upstream end while the fixing belt rotates.

FIG. 10 is a cross-sectional view of yet another example of the pressing member 40 used in the fixing device 30 pertaining to the embodiment of the present invention. According to this embodiment, the elastic pressing part 41, made of an elastic material, is directly supported by the supporting frame 48, and thus the pressing member 40 is composed of the elastic pressing part 41 and the supporting frame 48. This means that in the second embodiment the elastic pressing part 41 is the first pressing part and the supporting frame 48 is the second pressing part.

The supporting frame 48 includes a frame body 48*a* and a supporting plate 48*b*. The frame body 48*a* is in the shape of a squared U that has an opening on the side of the fixing roller 31. The supporting plate 48*b* is attached to the frame body 48*a* to close the opening.

A downstream lateral side 48*c* of the frame body 48*a*, which is downstream from the other lateral side (i.e. an upstream lateral side 48*d*) with respect to the rotation direction of the pressure belt 32, is provided with a side wall 48*e*. The side wall 48*e* extends from the supporting plate 48*b* toward the fixing roller 31, along a downstream lateral side 41*d* of the elastic pressing part 41. The downstream lateral side 41*d* is downstream from the other lateral side with respect to the rotation direction of the pressure belt 32. The edge of the side wall 48*e*, which faces toward the fixing roller 31, is near the elastic pressing face 41*a*.

The upstream lateral side 48*d* of the frame body 48*a* is provided with a side wall 48*f*. The side wall 48*f* extends from the supporting plate 48*b* toward the fixing roller 31, along the upstream lateral side 41*b* of the elastic pressing part 41. The edge of the side wall 48*f* on the side of the fixing roller 31 is bent at a right angle toward the upstream lateral side 41*b* of the elastic pressing part 41. This edge is hereinafter referred to as a protrusion 48*g*. The protrusion 48*g* extends across the full width of the side wall 48*f* with respect to the width direction of the pressure belt 32.

The elastic pressing part 41, which is supported by the supporting plate 48*b*, is provided with a groove 41*f* which the protrusion 48*g* fits into. The groove 41*f* has a rectangular cross section, and extends across the full width of the elastic pressing part 41, with respect to the width direction of the pressure belt 32. The upstream end 44*a* of the low friction sheet 44 passes along the inside surface of the groove 41*f*. The upstream end 44*a* is hold between the protrusion 48*g* and the inside surface of the groove 41*f* of the elastic pressing part 41.

As described above, the full width of the upstream end 44*a* of the low friction sheet 44, with respect to the width direction of the pressure belt 31, is sandwiched between the protrusion 48*g* of the supporting frame 48 and the elastic pressing part 41. Thus, the pulling force applied to the upstream end 44*a* is evenly distributed across the whole area of the upstream end 44*a*. Therefore, the stress due to the pulling force is not intensively applied to any particular area on the upstream end 44*a*. This prevents the low friction sheet 44 from being damaged, and prevents wrinkles from being made on the low friction sheet 44. Furthermore, this prevents the upstream end 44*a* from slipping out from the groove 41*f*.

Modification Example of the Image Forming Apparatus

Image forming apparatuses to which the fixing device pertaining to the present invention can be applied are not limited to color printers as described above as embodiments. The fixing device is applicable to any type of monochrome and color image forming apparatuses, such as photocopying machines, fax machines, and MFPs (Multiple Function Peripherals).

As described above, in the fixing device pertaining to the embodiments of the present invention, the full width, with respect to the width direction of the pressure belt, of the upstream end of the low friction sheet between the pressure belt and the fixing member is sandwiched between the first pressing part and the side wall of the second pressing part. Here, the upstream end is upstream from the other end, with respect to the rotation direction of the pressure belt. Thus, when a pulling force is applied to the low friction sheet by the rotation of the pressure belt, the pulling force is evenly distributed across the whole area of the upstream end. Thus, the stress due to the pulling force is not intensively applied to any particular area on the upstream end. This prevents the low friction sheet from being damaged, and prevents wrinkles from being made on the low friction sheet. In this way, the structure realizes long-term stability of the low friction sheet.

It is preferable that the side wall of the second pressing part has a protrusion that depresses the elastic pressing part of the first pressing part via the low friction sheet, and the upstream end of the low friction sheet is sandwiched between the protrusion and the elastic pressing part.

It is also preferable that the elastic pressing part of the first pressing part has an elastic presser that protrudes toward the side wall of the second pressing part, and the upstream end of the low friction sheet is pressed by the elastic presser against the side wall and is thereby sandwiched between the elastic presser and the side wall.

It is also preferable that the first pressing part further includes a reinforcing member that is harder than the elastic presser and is attached to a rear face of the elastic presser.

It is also preferable that the reinforcing member of the first pressing part has a sheet holder that is provided near the side wall of the second pressing part, and the upstream end of the low friction sheet is sandwiched between the sheet holder of the first pressing part and the side wall.

It is also preferable that the sheet holder of the reinforcing member protrudes toward the side wall of the second pressing part farther than the elastic presser, the side wall is provided with a groove that the sheet holder fits into, and the upstream end of the low friction sheet is pressed by the sheet holder against an inside surface of the groove, and is thereby sandwiched between the sheet holder and the side wall.

It is also preferable that the low friction sheet passes along the inside surface of the groove and between the rear face of the reinforcing member and the second pressing part, and the second pressing part is provided with a depression that faces toward the rear face of the reinforcing member, the upstream end being inserted into the depression.

It is also preferable that the sheet holder of the reinforcing member is provided with an engaging groove that has a predetermined width along the width direction of the pressure belt, the side wall of the second pressing part is provided with an engaging protrusion that has a predetermined width along the width direction of the pressure belt and engages with the engaging groove, and the upstream end of the low friction sheet is pressed by the engaging protrusion against an inside surface of the engaging groove, and thereby sandwiched between the side wall and the reinforcing member.

It is also preferable that the engaging protrusion of the side wall has a sharp edge and thus has a triangular cross section, and the engaging groove has a triangular cross section that matches the cross section of the engaging protrusion.

It is also preferable that the second pressing part is provided with a rigid presser that presses against a downstream part of the pressure belt via the low friction sheet, the rigid presser being harder than the elastic pressing part of the first pressing part, and the downstream part being downstream from a part of the pressure belt that is pressed by the elastic pressing part, with respect to the rotation direction of the pressure belt.

It is also preferable that the second pressing part is a supporting frame that supports the elastic pressing part of the first pressing part while applying a pressing force against a rear face of the elastic pressing part.

It is also preferable that the side wall of the second pressing part has a protrusion that protrudes toward the elastic pressing part of the first pressing part, and the protrusion presses against the elastic pressing part via the low friction sheet, and the upstream end of the low friction sheet is thereby sandwiched between the protrusion and the elastic pressing part.

It is also preferable that the elastic pressing part of the first pressing part is provided with a groove that the protrusion of the side wall fits into, and a portion of the low friction sheet near the upstream end is pressed by the protrusion against an inside surface of the groove, and is thereby sandwiched between the elastic pressing part and the side wall.

It is also preferable that a width of the upstream end of the low friction sheet sandwiched between the side wall of the second pressing part and the upstream portion of the first pressing part is no shorter than a width of recording sheet with respect to the width direction of the pressure belt.

The present invention is applicable to a fixing device in which a fixing nip is formed by pressing a pressure belt, which rotates while being applied a pressure from a pressing member via a low friction sheet, against a fixing roller, for preventing the low friction sheet from being damaged. This realizes long-term stability of the low friction sheet.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes a first pressing part whose front-side portion, which faces the pressure belt, is made of an elastic material, and a second pressing part whose front face presses against a rear face of the first pressing part, the second pressing part has a side wall that is provided near an upstream portion of the first pressing part or elastically presses against the upstream portion, the upstream portion being upstream from the front-side portion with respect to a rotation direction of the pressure belt, an upstream end of the low friction sheet is sandwiched between the side wall and the upstream portion, which is near the side wall or is elastically pressed by the sidewall, of the first pressing part, the upstream end being upstream with respect to the rotation direction of the pressure belt, the first pressing part includes an elastic pressing part that is made of an elastic material, and a reinforcing member that is harder than the elastic pressing part and is attached to a rear face of the elastic pressing part, and the upstream end of the low friction sheet is sandwiched between the side wall and the reinforcing member.

2. The fixing device of claim 1, wherein the reinforcing member has a sheet holder that is provided near the side wall, the sheet holder protruding toward the side wall farther than the elastic pressing part does, the side wall is provided with a groove that the sheet holder fits into, and the upstream end of the low friction sheet is pressed by the sheet holder against an inside surface of the groove, and is thereby sandwiched between the sheet holder and the side wall.

3. The fixing device of claim 2, wherein the upstream end of the low friction sheet passes along the inside surface of the groove toward the second pressing part, and the second pressing part is provided with a depression into which the upstream end is inserted.

4. The fixing device of claim 1, wherein a surface of the reinforcing member, the surface facing the side wall, is provided with a groove that has a predetermined length, the side wall is provided with an engaging protrusion that engages with the groove over a predetermined length, and the upstream end of the low friction sheet is pressed by the engaging protrusion against an inside surface of the groove, and is thereby sandwiched between the side wall and the reinforcing member.

5. The fixing device of claim 4, wherein the engaging protrusion of the side wall has a sharp edge and thus has a triangular cross section, and the groove has a triangular cross section that matches the cross section of the engaging protrusion.

6. The fixing device of claim 5, wherein the second pressing part is provided with a presser that presses against a downstream part of the pressure belt via the low friction sheet, the presser being harder than the elastic pressing part, and the downstream part being downstream from a part of the pressure belt that is pressed by the elastic pressing part, with respect to the rotation direction of the pressure belt.

7. A fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes a first pressing part whose front-side portion, which faces the pressure belt, is made of an elastic material, and a second pressing part whose front face presses against a rear face of the first pressing part, the second pressing part has a side wall that is provided near an upstream portion of the first pressing part or elastically presses against the upstream portion, the upstream portion being upstream from the front-side portion with respect to a rotation direction of the pressure belt, an upstream end of the low friction sheet is sandwiched between the side wall and the upstream portion, which is near the side wall or is elastically pressed by the sidewall, of the first pressing part, the upstream end being upstream with respect to the rotation direction of the pressure belt, the first pressing part includes an elastic pressing part that is made of an elastic material, and a reinforcing member that is harder than the elastic pressing part and is attached to a rear face of the elastic pressing part, the side wall has a protrusion that depresses the elastic pressing part, and the upstream end of the low friction sheet is sandwiched between the protrusion and the elastic pressing part as the protrusion depresses the elastic pressing part.

8. A fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes a first pressing part whose front-side portion, which faces the pressure belt, is made of an elastic material, and a second pressing part whose front face presses against a rear face of the first pressing part, the second pressing part has a side wall that is provided near an upstream portion of the first pressing part or elastically presses against the upstream portion, the upstream portion being upstream from the front-side portion with respect to a rotation direction of the pressure belt, an upstream end of the low friction sheet is sandwiched between the side wall and the upstream portion, which is near the side wall or is elastically pressed by the sidewall, of the first pressing part, the upstream end being upstream with respect to the rotation direction of the pressure belt, the first pressing part includes an elastic presser that is made of an elastic material, and a reinforcing member that is harder than the elastic presser and is attached to a rear face of the elastic presser, the elastic presser has a protruding end that protrudes toward the side wall, and the upstream end of the low friction sheet is sandwiched between the protruding end and the side wall as the side wall is elastically pressed by the protruding end.

9. A fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes a first pressing part whose front-side portion, which faces the pressure belt, is made of an elastic material, and a second pressing part whose front face presses against a rear face of the first pressing part, the second pressing part has a side wall that is provided near an upstream portion of the first pressing part or elastically presses against the upstream portion, the upstream portion being upstream from the front-side portion with respect to a rotation direction of the pressure belt, an upstream end of the low friction sheet is sandwiched between the side wall and the upstream portion, which is near the side wall or is elastically pressed by the sidewall, of the first pressing part, the upstream end being upstream with respect to the rotation direction of the pressure belt, the first pressing part includes an elastic pressing part that is made of an elastic material, the second pressing part is a supporting frame that supports the elastic pressing part while applying a pressing force against a rear face of the elastic pressing part, the side wall has a protrusion that protrudes toward the elastic pressing part, and the protrusion presses against the elastic pressing part via the low friction sheet, and the upstream end of the low friction sheet is thereby sandwiched between the protrusion and the elastic pressing part.

10. The fixing device of claim 9, wherein the elastic pressing part is provided with a groove that the protrusion fits into, and a portion of the low friction sheet near the upstream end is pressed by the protrusion against an inside surface of the groove, and is thereby sandwiched between the elastic pressing part and the side wall.

11. An image forming apparatus provided with a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes a first pressing part whose front-side portion, which faces the pressure belt, is made of an elastic material, and a second pressing part whose front face presses against a rear face of the first pressing part, the second pressing part has a side wall that is provided near an upstream portion of the first pressing part or elastically presses against the upstream portion, the upstream portion being upstream from the front-side portion with respect to a rotation direction of the pressure belt, an upstream end of the low friction sheet is sandwiched between the side wall and the upstream portion, which is near the side wall or is elastically pressed by the sidewall, of the first pressing part, the upstream end being upstream with respect to the rotation direction of the pressure belt, the first pressing part includes an elastic pressing part that is made of an elastic material, and a reinforcing member that is harder than the elastic pressing part and is attached to a rear face of the elastic pressing part, the side wall has a protrusion that depresses the elastic pressing part, and the upstream end of the low friction sheet is sandwiched between the protrusion and the elastic pressing part as the protrusion depresses the elastic pressing part.

12. An image forming apparatus provided with a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes a first pressing part whose front-side portion, which faces the pressure belt, is made of an elastic material, and a second pressing part whose front face presses against a rear face of the first pressing part, the second pressing part has a side wall that is provided near an upstream portion of the first pressing part or elastically presses against the upstream portion, the upstream portion being upstream from the front-side portion with respect to a rotation direction of the pressure belt, an upstream end of the low friction sheet is sandwiched between the side wall and the upstream portion, which is near the side wall or is elastically pressed by the side-wall, of the first pressing part, the upstream end being upstream with respect to the rotation direction of the pressure belt, the first pressing part includes an elastic presser that is made of an elastic material, and a reinforcing member that is harder than the elastic presser and is attached to a rear face of the elastic presser, the elastic presser has a protruding end that protrudes toward the side wall, and the upstream end of the low friction sheet is sandwiched between the protruding end and the side wall as the side wall is elastically pressed by the protruding end.

13. An image forming apparatus provided with a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes a first pressing part whose front-side portion, which faces the pressure belt, is made of an elastic material, and a second pressing part whose front face presses against a rear face of the first pressing part, the second pressing part has a side wall that is provided near an upstream portion of the first pressing part or elastically presses against the upstream portion, the upstream portion being upstream from the front-side portion with respect to a rotation direction of the pressure belt, an upstream end of the low friction sheet is sandwiched between the side wall and the upstream portion, which is near the side wall or is elastically pressed by the side-wall, of the first pressing part, the upstream end being upstream with respect to the rotation direction of the pressure belt, the first pressing part includes an elastic pressing part that is made of an elastic material, and a reinforcing member that is harder than the elastic pressing part and is attached to a rear face of the elastic pressing part, and the upstream end of the low friction sheet is sandwiched between the side wall and the reinforcing member.

14. The image forming apparatus of claim 13, wherein the reinforcing member has a sheet holder that is provided near the side wall, the sheet holder protruding toward the side wall farther than the elastic pressing part does, the side wall is provided with a groove that the sheet holder fits into, and the upstream end of the low friction sheet is pressed by the sheet holder against an inside surface of the groove, and is thereby sandwiched between the sheet holder and the side wall.

15. The image forming apparatus of claim 14, wherein the upstream end of the low friction sheet passes along the inside surface of the groove toward the second pressing part, and the second pressing part is provided with a depression into which the upstream end is inserted.

16. The image forming apparatus of claim 13, wherein a surface of the reinforcing member, the surface facing the side wall, is provided with a groove that has a predetermined length, the side wall is provided with an engaging protrusion that engages with the groove over a predetermined length, and the upstream end of the low friction sheet is pressed by the engaging protrusion against an inside surface of the groove, and is thereby sandwiched between the side wall and the reinforcing member.

17. The image forming apparatus of claim 16, wherein the engaging protrusion of the side wall has a sharp edge and thus has a triangular cross section, and the groove has a triangular cross section that matches the cross section of the engaging protrusion.

18. An image forming apparatus provided with a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes a first pressing part whose front-side portion, which faces the pressure belt, is made of an elastic material, and a second pressing part whose front face presses against a rear face of the first pressing part, the second pressing part has a side wall that is provided near an upstream portion of the first pressing part or elastically presses against the upstream portion, the upstream portion being upstream from the front-side portion with respect to a rotation direction of the pressure belt, an upstream end of the low friction sheet is sandwiched between the side wall and the upstream portion, which is near the side wall or is elastically pressed by the side-wall, of the first pressing part, the upstream end being upstream with respect to the rotation direction of the pressure belt, and the second pressing part is provided with a presser that presses against a downstream part of the pressure belt via the low friction sheet, the presser being harder than the front-side portion of the first pressing part, and the downstream part being downstream from a part of the pressure belt that is pressed by the front-side portion of the first pressing part, with respect to the rotation direction of the pressure belt.

19. An image forming apparatus provided with a fixing device for fixing an unfixed image on a recording sheet by applying heat and pressure to the unfixed image while the recording sheet is passing through a fixing nip, the fixing nip being formed by pressing a pressing member against an inside surface of a rotatable pressure belt via a low friction sheet, so that an outside surface of the pressure belt presses against a rotatable fixing member, wherein the pressing member includes a first pressing part whose front-side portion, which faces the pressure belt, is made of an elastic material, and a second pressing part whose front face presses against a rear face of the first pressing part, the second pressing part has a side wall that is provided near an upstream portion of the first pressing part or elastically presses against the upstream portion, the upstream portion being upstream from the front-side portion with respect to a rotation direction of the pressure belt, an upstream end of the low friction sheet is sandwiched between the side wall and the upstream portion, which is near the side wall or is elastically pressed by the side-wall, of the first pressing part, the upstream end being upstream with respect to the rotation direction of the pressure belt, the first pressing part includes an elastic pressing part that is made of an elastic material, the second pressing part is a supporting frame that supports the elastic pressing part while applying a pressing force against a rear face of the elastic pressing part, the side wall has a protrusion that protrudes toward the elastic pressing part, and the protrusion presses against the elastic pressing part via the low friction sheet, and the upstream end of the low friction sheet is thereby sandwiched between the protrusion and the elastic pressing part.

20. The image forming apparatus of claim 19, wherein the elastic pressing part is provided with a groove that the protrusion fits into, and a portion of the low friction sheet near the upstream end is pressed by the protrusion against an inside surface of the groove, and is thereby sandwiched between the elastic pressing part and the side wall.

* * * * *